US006987508B2

(12) United States Patent
Numata et al.

(10) Patent No.: US 6,987,508 B2
(45) Date of Patent: Jan. 17, 2006

(54) MANUAL INPUT DEVICE WHICH PROVIDES ITS CONTROL KNOB WITH PLURAL MODES OF OPERATION FEELING, AND CAR-MOUNTED APPARATUS CONTROLLER BASED THEREON

(75) Inventors: Hidetaka Numata, Miyagi-ken (JP); Mikio Onodera, Miyagi-ken (JP); Kenichi Seino, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 74 days.

(21) Appl. No.: 10/036,798

(22) Filed: Dec. 20, 2001

(65) Prior Publication Data

US 2002/0080114 A1 Jun. 27, 2002

(30) Foreign Application Priority Data

Dec. 22, 2000 (JP) ..... 2000-390765
Dec. 22, 2000 (JP) ..... 2000-391230

(51) Int. Cl.
*G09G 5/00* (2006.01)

(52) U.S. Cl. ..... 345/184; 345/161; 74/485; 715/970

(58) Field of Classification Search ..... 345/156, 345/161, 184, 970; 74/471 XY, 485, 553; 463/38, 370, 30; 318/109, 685, 432; 341/20, 341/22, 35; 715/970
See application file for complete search history.

(56) References Cited

U.S. PATENT DOCUMENTS 5,185,561 A * 2/1993 Good et al. ..... 318/432
5,944,151 A * 8/1999 Jakobs et al. ..... 188/267.1
6,057,828 A 5/2000 Rosenberg et al.
6,154,201 A * 11/2000 Levin et al. ..... 345/184
6,256,011 B1 * 7/2001 Culver ..... 345/157
6,320,487 B1 * 11/2001 Miller et al. ..... 335/274
6,476,794 B1 * 11/2002 Kataoka et al. ..... 345/161

* cited by examiner

*Primary Examiner*—Amr A. Awad
(74) *Attorney, Agent, or Firm*—Brinks Hofer Gilson & Lione

(57) ABSTRACT

A changeable operation feeling (tactile sensation) is provided for a user manipulating the knob of manual input device. The manual input device includes a feeling providing device which has plural discs fixed to a control shaft, bearing feeling patterns on their circumferential surfaces and a ball holder which works in conjunction with the discs to provide an operation feeling to the knob. An actuator is driven to move up or down the ball holder to select the feeling pattern to be elastically forced to contact the ball to change an operation feeling as the user rotates the knob. A car-mounted apparatus controller incorporates this type of manual input device for functional control of car-mounted electric apparatuses.

13 Claims, 16 Drawing Sheets

MANUAL INPUT DEVICE WHICH PROVIDES ITS CONTROL KNOB WITH PLURAL MODES OF OPERATION FEELING, AND CAR-MOUNTED APPARATUS CONTROLLER BASED THEREON

BACKGROUND OF THE INVENTION

1. Field of the Invention

The present invention relates to manual input devices also called mechanical switches, and particularly to feeling providing means which can provide a knob with a plurality of operation feeling (tactile sensation or force feedback) modes.

2. Description of Related Art

Conventionally a manual input device which has a knob and a position sensor for detecting the amount and direction of manipulation of the knob has been well known. Generally, this type of manual input device has feeling providing means for giving the knob the required kinesthetic force or clicking sensation so that the knob can be adequately manipulated with a satisfactory operation feeling.

FIGS. 17A and 17B show one example of a conventional manual input device of this type. In this case, it is a rotary manual input device; as clearly illustrated in the figures, it is mainly composed of a housing 101; a rotary shaft 102 which is rotatably supported by the housing 101 with one end of it protruding out through an opening 101*a* made in the housing 101; a knob 103 which is fixed to one end of the rotary shaft 102 protruding from the housing 101; feeling providing means 104 housed in the housing 101; and a position sensor 105. The feeling providing means 104 comprises a disc 107, fixed to the rotary shaft 102, with a prescribed arrangement of many dents 106 for a feeling pattern on its circumferential surface; and a ball 109 which is held pushed in one direction by an elastic body 108 and in contact with the circumferential surface of the disk 107. The position sensor 105 consists of a code-disc 110 fixed to the rotary shaft 102 and a photo-interrupter 111 with a light emitting element 111*a* and a light detecting element 111*b* facing each other on the front and back sides of the code-disc 110, respectively.

In this manual input device, as the knob 103 is rotated around the axis of the rotary shaft 102, the rotary shaft 102, disc 107 and code-disc 110 rotate in the same direction by the same amount as the knob 103. As the disc 107 rotates, the ball 109 held pushed in one direction by the elastic body 108 disengages from a dent 106 on the circumferential surface of the disc 107, slides up onto the land (portion with no dents 106), then engages with a neighboring dent 106. This cycle is repeated depending on the amount of rotation of the knob 103 and a change in the manipulation force is conveyed to the knob 103 as a clicking sensation. As the code-disc 110 rotates, slits 110*a* made in the code-disc 110 cross the set point for the light emitting element 111*a* and light detecting element 111*b*; the number of slits 110*a* which have crossed it and their direction are detected by the photo-interrupter 111 to get positional signals such as those for the amount and direction of rotation of the knob 103.

This type of manual input device is usually installed in a car-mounted apparatus controller provided in a car and used to control the functions of various car-mounted electric apparatuses such as an air conditioner, radio, TV, CD player and navigation system.

Such a car-mounted apparatus controller integrates the following mechanisms: a selection switch for selecting an electric apparatus to be controlled; a function selection switch for selecting one of various functions of the electric apparatus selected by the selection switch; and a manual input device for controlling the function selected by the function selection switch. Here, a knob as part of the manual input device is manipulated in order to control the various functions of each electric apparatus. By using this car-mounted apparatus controller, a driver can control the various functions of each electric apparatus by means of the conveniently located electric apparatus selection switches, function selection switches and manual input device, so that he/she can control the functions of various electric apparatuses easily and adequately without his/her safe drive being interrupted.

However, since, as shown in FIG. 17 the conventional manual input device has only one row of dents 106 as a feeling pattern and only one ball 109 to engage with these dents 106, it is impossible to change the knob operation feeling as necessary. Therefore, if the conventional manual input device is applied to a car-mounted apparatus controller, the user only experiences the same operation feeling through the knob 103 when controlling, for example, the temperature of the air conditioner as when controlling its air flow rate. This tends to cause the user to fail to do functional control properly.

SUMMARY OF THE INVENTION

In order to solve the above problem in the prior art, an object of the present invention is to provide a highly operable manual input device which can change the knob operation feeling as appropriate, and also provide a highly operable car-mounted apparatus controller which uses this type of manual input device.

As a solution to the above problem, a manual input device according to the present invention comprises a knob, feeling providing means which have at least two kinds of feeling patterns, and an actuator which activates the feeling providing means and changes an operation feeling provided to the knob.

In this constitution, the actuator is driven to activate the feeling providing means so as to change the operation feeling provided to the knob as appropriate, which improves the operability of the manual input device and makes apparatus functional control with the manual input device easy and accurate.

Also, a manual input device comprises a knob, feeling providing means which provides the knob with an operation feeling, an actuator which activates the feeling providing means, detecting means which detects an operating condition of the knob, and an input/output section which exchanges signals with an external device controlled by the knob, wherein the actuator is controlled according to a control signal generated based on an external signal from external detecting means connected at least with the external device.

When a manual input device is provided with such feeling providing means and such an actuator, the operation feeling given to the knob can be changed as appropriate by activating the feeling providing means through the actuator, so the operability of the manual input device is improved and functional control of an apparatus with the manual input device can be done easily and adequately. When the actuator for activating the feeling providing means is controlled according to a control signal generated based on an external signal at least from external detecting means, fine control of the actuator can be made in a manner to suit the condition of the external device, which prevents discrepancy between the external device's operating condition and the knob manipulation, thereby enhancing the operability and reliability of the manual input device.

Also, a manual input device comprises a knob, feeling providing means which provides the knob with an operation feeling, an actuator which activates the feeling providing means, a control section for the actuator, detecting means which detects an operating condition of the knob, and an input/output section which exchanges signals with an external device controlled by the knob, wherein an external signal from external detecting means connected at least with the external device is inputted into the control section through the input/output section to generate a control signal for the actuator to match at least the external signal, and wherein the actuator is controlled according to the control signal.

When a manual input device is provided with a control section and all detection signals and external signals are inputted into the control section in this way, it is unnecessary to modify the external device and thus application of the manual input device to the external device is easy.

Also, a manual input device comprises a knob, feeling providing means which provides the knob with an operation feeling, an actuator which activates the feeling providing means, a control section for the actuator, detecting means which detects an operating condition of the knob, and an input/output section which exchanges signals with an external device controlled by the knob, wherein both a detection signal at least from the detecting means and an external signal from external detection means connected with the external device are inputted into the external device to generate control information for the actuator to match the detection signal and the external signal, wherein the control information is picked up by the control section through the input/output section to generate a control signal for the actuator to match the control information, and wherein the actuator is controlled according to the control signal.

When control information which matches detection and external signals is generated in the external device and transmitted to the control section in this way, the workload on the control section is reduced and thus the actuator control speed can be increased.

Also, a manual input device comprises a knob, feeling providing means which provides the knob with an operation feeling, an actuator which activates the feeling providing means, detecting means which detects an operating condition of the knob, and an input/output section which exchanges signals with an external device controlled by the knob, wherein both a detection signal at least from the detecting means and an external signal from external detection means connected with the external device are inputted into the external device to generate a control signal for the actuator to match the detection signal and the external signal, and wherein the actuator is controlled according to the control signal.

When an actuator control signal which matches detection and external signals is generated in the external device to control the actuator in the manual input device in this way, the control section in the manual input device can be omitted and thus a compact, less costly manual input device can be realized.

Furthermore, the knob in a manual input device as mentioned above is designed to be manipulated by linear movement.

When a sliding manual input device is provided with such a linearly operable knob in this way, the operability of the sliding manual input device is improved and functional control of an apparatus with the sliding manual input device can be done easily and adequately.

Furthermore, the knob in a manual input device as mentioned above is designed to be manipulated by rotation.

When a rotary manual input device is provided with such a rotatable knob, the operability of the rotary manual input device is improved and functional control of an apparatus with the device can be done easily and adequately.

Furthermore, the knob in a manual input device as mentioned above is designed to be manipulated by rotating it in at least two directions.

When a joystick type manual input device is provided with such a knob rotatable in at least two directions, the operability of the joystick type manual input device is improved and functional control of an apparatus with the device can be done easily and adequately.

The feeling providing means in a manual input device as mentioned above is composed of a disc or cylinder which bears plural feeling patterns (rows) and is fixed to a control shaft to be manipulated by the knob; and a ball or pin elastically forced to contact the disc or cylinder; and the actuator linearly reciprocates the above ball or pin in a direction where the plural feeling patterns (rows) are arranged.

In this constitution, the actuator is driven to let the ball or pin selectively contact one of the feeling patterns to give the knob an operation feeling corresponding to the feeling pattern in contact with the ball or pin and thus provide the knob with different modes of operating feeling, so the operability of the manual input device is improved and functional control of an apparatus with the device can be done easily and adequately.

The feeling providing means in a manual input device as mentioned above is composed of a disc or cylinder which bears a feeling pattern (row) and is fixed to a control shaft to be manipulated by the knob; and plural balls or pins elastically forced to contact the disc or cylinder; and the actuator linearly reciprocates one of the plural balls or pins in a direction where it selectively engages with the feeling pattern.

In this constitution, the actuator is driven to let one of the balls or pins contact the feeling pattern to give the knob an operation feeling corresponding to the shape or size of that ball or pin and thus provide the knob with different modes of operation feeling, so the operability of the manual input device is improved and functional control of an apparatus with the device can be done easily and adequately.

The feeling providing means in a manual input device as mentioned above consists of a rotary polyhedron which bears plural feeling patterns (rows) arranged in parallel in an axial direction of its outer surface; and the actuator reciprocally rotates the above rotary polyhedron around its axis, with one end of a control shaft to be manipulated by the knob being in contact with the outer surface of the rotary polyhedron bearing the feeling patterns.

In this constitution, the actuator is driven to rotate the rotary polyhedron around its axis and let one end of the control shaft to be manipulated by the knob contact one of the plural feeling patterns formed on the outer surface of the rotary polyhedron to give the knob an operation feeling corresponding to the feeling pattern in contact with one end of the control shaft and thus provide the knob with different modes of operation feeling, so the operability of the manual input device is improved and functional control of an apparatus with the device can be done easily and adequately.

On the other hand, the car-mounted apparatus controller incorporates a function selection switch for selecting one function among various functions to be controlled and a manual input device for controlling the function selected by the function selection switch. Here, the manual input device comprises a knob, feeling providing means having at least two kinds of feeling patterns and an actuator for activating the feeling providing means and changing an operation feeling given to the knob.

When the car-mounted apparatus controller uses such a manual input device comprising a knob, feeling providing means having feeling patterns and an actuator for activating the feeling providing means and changing the operation feeling given to the knob, the actuator is driven to activate the feeling providing means to change the operation feeling given to the knob as appropriate so that a different operation feeling can be provided to the knob depending on the type of control required for each car-mounted electric apparatus and, therefore, the operability of the car-mounted apparatus controller is improved and functional control of an apparatus with it can be done easily and adequately.

Also, a car-mounted apparatus controller comprises: an electric apparatus selection switch for selecting an electric apparatus to be controlled; a function selection switch for selecting one of various functions of the electric apparatus selected by the apparatus selection switch; and a manual input device for controlling a function selected by the function selection switch. Here, the manual input device comprises: a knob, feeling providing means for providing the knob an operation feeling, an actuator for activating the feeling providing means, detecting means for detecting an operating condition of the knob, and an input/output section which exchanges signals with an external device controlled by the knob. The actuator is controlled according to a control signal generated based on both a detection signal at least from the detecting means and an external signal from external detecting means connected with the external device.

When the car-mounted apparatus controller uses such a manual input device comprising a knob, feeling providing means and an actuator for the feeling providing means, the actuator is driven to activate the feeling providing means to change the operation feeling given to the knob as appropriate so that a different operation feeling can be provided to the knob depending on the type of control required for each car-mounted electric apparatus. Therefore, the operability of the car-mounted apparatus controller is improved and functional control of an apparatus with it can be done easily and adequately. Also, when the manual input device in the car-mounted apparatus controller uses an actuator which is controlled according to a control signal generated based on both a detection signal at least from detecting means and an external signal from external detecting means connected with the external device, the actuator can be finely controlled in a manner to match the condition of the electric apparatus, which prevents discrepancy between the operating condition of the electric apparatus and the manipulation of the knob, thereby enhancing the operability and reliability of the car-mounted apparatus controller.

BRIEF DESCRIPTION OF THE DRAWINGS

The invention will be more particularly described with reference to the accompanying drawings, in which.

DETAILED DESCRIPTION OF THE PREFERRED EMBODIMENTS

Next, manual input devices as preferred embodiments of the present invention will be described in detail.

<Manual Input Device—Embodiment 1>

Figure 1:
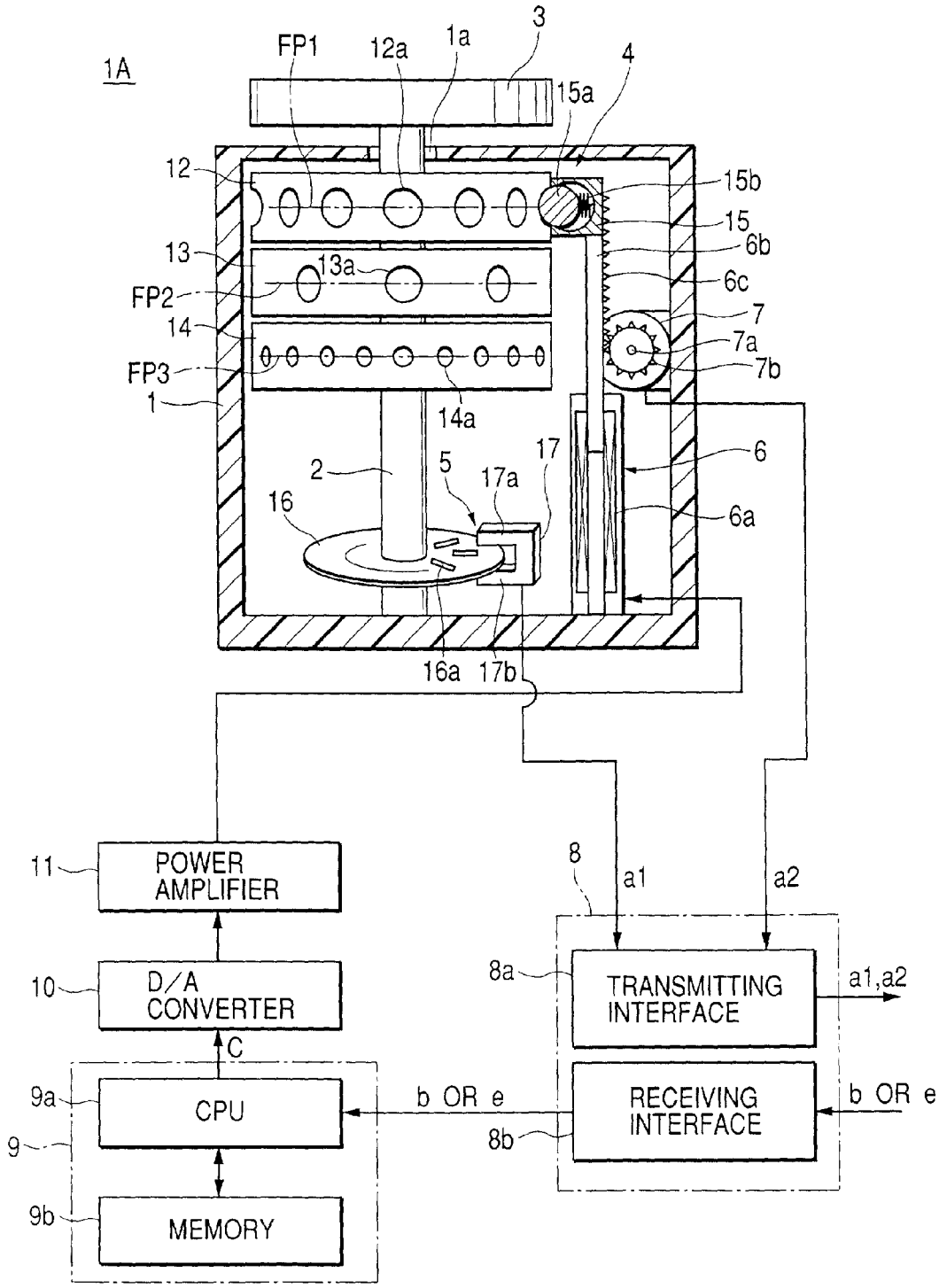
FIG. 1 shows the configuration of a manual input device according to a first embodiment of the invention.

FIG. 1 shows a manual input device 1A according to a first embodiment of the invention. This manual input device 1A is of the rotary type; as clearly seen from this figure, it comprises: a housing 1; a control shaft 2 which is rotatably supported by the housing 1 with one end of it protruding out through an opening 1*a* made in the housing 1; and a knob 3 which is fixed to one end of the control shaft 2 protruding from the housing 1, wherein the housing 1 houses feeling providing means 4, first detecting means 5 for detecting the amount and direction of rotation of the control shaft 2 and knob 3, an actuator 6 for activating the feeling providing means 4 to change the operation feeling given to the knob 3 and second detecting means 7 for detecting the amount and direction of drive of the actuator 6. This manual input device 1A further comprises: an input/output section 8 which exchanges signals with an external device (not shown); a controller 9 which generates and outputs a control signal c for the actuator 6 based on an external signal b from external detecting means connected with the invisible external device, or based on control information e generated based at least on external signal b; a D/A converter 10 for converting the control signal c from the controller 9 into an analog signal; and a power amplifier 11 for amplifying the analog signal as a result of conversion of the control signal c by the D/A converter 10 to obtain the power to drive the actuator 6. Here, if the actuator 6 is a stepping motor, the D/A converter 10 can be omitted.

The feeling providing means 4 comprises plural discs (in FIG. 1, three discs) 12, 13, 14 all fixed to the control shaft 2 and a ball holder 15 for providing an operation feeling to the knob 3 in conjunction with the discs 12, 13, 14. Formed on the circumferential surface of the disc 12 is a first feeling pattern FP1 where dents 12*a* with a large diameter are evenly spaced with a medium pitch; formed on the disk 13's circumferential surface is a second feeling pattern FP2 where dents 13*a* with a medium diameter are evenly spaced with a large pitch; and formed on the disk 14's circumferential surface is a third feeling pattern FP3 where dents 14*a* with a small diameter are evenly spaced with a small pitch. The ball holder 15 has a ball 15*a* elastically forced to selectively contact one of the discs 12, 13, 14, and an elastic material 15*b* which pushes and holds the ball 15*a* outward to elastically force it to contact the circumferential surface of one of the discs 12, 13, 14.

The first detecting means 5 is a rotary encoder consisting of a code-disc 16 fixed to the control shaft 2 and a photo-interrupter 17 with a light emitting element 17*a* and a light detecting element 17*b* facing each other on the front and back sides of the code-disc 16, respectively. The code-disc 16 has many slits 16*a* arranged in a prescribed manner and the slit 16*a* which has crossed the photo-interrupter 17 is detected to get positional signals such as those for the amount and direction of rotation of the control shaft 2 and knob 3.

The actuator 6 has an electromagnet 6*a* and a solenoid which consists of a drive shaft 6*b* which linearly reciprocates in steps by means of the electromagnet 6*a*, with the ball holder 15 mounted on the tip of the drive shaft 6*b*. On the drive shaft 6*b* is a rack 6*c* engaged with a pinion 7*b* fixed to a rotary shaft 7*a* of second detecting means 7 (mentioned below) for driving the second detecting means 7. The actuator 6 changes the excited state of the electromagnet 6*a* to alter the amount of protrusion of the drive shaft 6*b* to change the disc (12, 13 or 14) to contact the ball 15*a*. When the ball 15*a* is elastically made to contact the circumferential surface of the disc 12, a continuous operation feeling with a large tactile sensation is provided to the knob 3. When the ball 15*a* is elastically made to contact the circumferential surface of the disc 13, an intermittent operation feeling with a large tactile sensation is provided to the knob 3. When the ball 15*a* is elastically made to contact the circumferential surface of the disc 14, a continuous operation feeling with a small tactile sensation is provided to the knob 3.

The second detecting means 7 is a rotary position sensor such as a rotary encoder or rotary variable resistor. This second detecting means 7 is connected to the drive shaft 6*b* of the actuator 6 through the rack 6*c* and the pinion 7*b* engaged with the rack 6*c*; it detects the amount of protrusion of the drive shaft 6*b* from the electromagnet 6*a* and which disc (12, 13 or 14) is in contact with the ball 15*a*.

The input/output section 8 consists of a transmitting interface 8*a* and a receiving interface 8*b*; the transmitting interface 8*a* sends detection signals a1 and a2 from the first detecting means 5 and the second detecting means 7 to an external device (not shown).

The controller 9 consists of a CPU 9*a* and a memory 9*b*; the memory 9*b* stores data and a program for analyzing the external signal b or control information e generated based at least on the external signal b, as well as data and a program for driving the actuator 6. The CPU 9*a* picks up the external signal b or control information e, analyzes the external signal b or control information e according to the data and program stored in the memory 8*b*, determines a control signal c to match the external signal b or control information e according to the data and program in the memory 8*b*, then outputs it to the D/A converter 10 to drive the actuator.

The control signal c is a signal which corresponds to an operation feeling given to the knob 3. Such signals are categorized into several types: ones to "make vibration", ones to "make impact" and ones to "modify working force" and so on. In the case of a signal to make vibration, the control signal c will represent the intensity, form, vibration application duration and frequency of vibration. In the case of a signal to make impact, the control signal c will represent the intensity, form and number of application times of impact. In the case of a signal to modify working force, the control signal c will represent the intensity, direction and application duration of working force. Control information e is a command version of the control signal c. If working force is to be modified according to a pattern, control information e may be a command to express the pattern. Alternatively, control information e may contain the detection signal a showing the amount of application and a signal from another external detecting means (not shown) which is inputted to the external device.

In this manual input device 1A, the actuator 6 is driven to move the ball holder 15 to change the disc (12, 13 or 14) to elastically contact the ball 15*a*. After the ball 15*a* is made to contact the circumferential surface of the required disc (12, 13 or 14), as the user rotates the knob 3 around the axis of the control shaft 2, the control shaft 2 and the disc 12, 13 or 14 turns along with the knob 3, the ball 15*a*, which is held pushed in one direction by the elastic material 15*b*, disengages from a dent 12*a*, 13*a* or 14*a* on the circumferential surface of the disc 12, 13 or 14, slides up to the land, then engages with a neighboring dent 12*a*, 13*a* or 14*a*; this cycle is repeated as the knob 3 is turned. As the manipulation force changes, a clicking sensation is thus given to the knob 3. As mentioned above, the circumferential surfaces of the discs 12, 13 and 14 bear feeling patterns FP1 to FP3 made up of plural dents 12*a*, 13*a* and 14*a* which differ in size and the pitch between dents, respectively. By changing the disc (12, 13 or 14) to contact the ball 15*a*, the clicking sensation provided to the knob 3 can be changed. As the knob 3 is rotated, the code-disc 16 also turns along with the control shaft 2 and the amount and direction of rotation of the knob 3 are detected by the photo-interrupter 17.

Thus, in this manual input device 1A, the feeling providing means 4 comprises plural discs 12, 13, 14 fixed to the control shaft 2, bearing different feeling patterns FP1 to FP3 respectively on the circumferential surfaces, and a ball holder 15 which holds the ball 15*a* to contact the circumferential surface of one of these discs so that the disc (12, 13, or 14) to contact the ball 15*a* is selected by means of the actuator 6. This makes it possible to provide different modes of operation feeling to the knob 3 fixed to the control shaft 2; therefore, functional control of an apparatus can be done easily and adequately with this manual input device 1A. Further, provision of plural discs 12, 13, 14 fixed to the control shaft 2 means that it is easy to change the feeling pattern (FP1 to FP3) or increase/decrease the number of feeling patterns. In addition, in this manual input device 1A, the CPU 9*a* picks up an external signal b or control information e from external detecting means connected with an external device (not shown) in order to determine a control signal c for the actuator 6, so the actuator 6 can be appropriately controlled in a manner to suit the condition of the external device. Accordingly, depending on the condition of the external device, the actuator 6 can be driven so as to let the ball 15*a* in the ball holder 15 contact the disc which bears a feeling pattern disabling manipulation of the knob 3; this prevents discrepancy between the external device operating condition and the knob manipulation, thereby enhancing the operability and reliability of the manual input device 1A.

<Manual Input Device—Embodiment 2>

Figure 2:
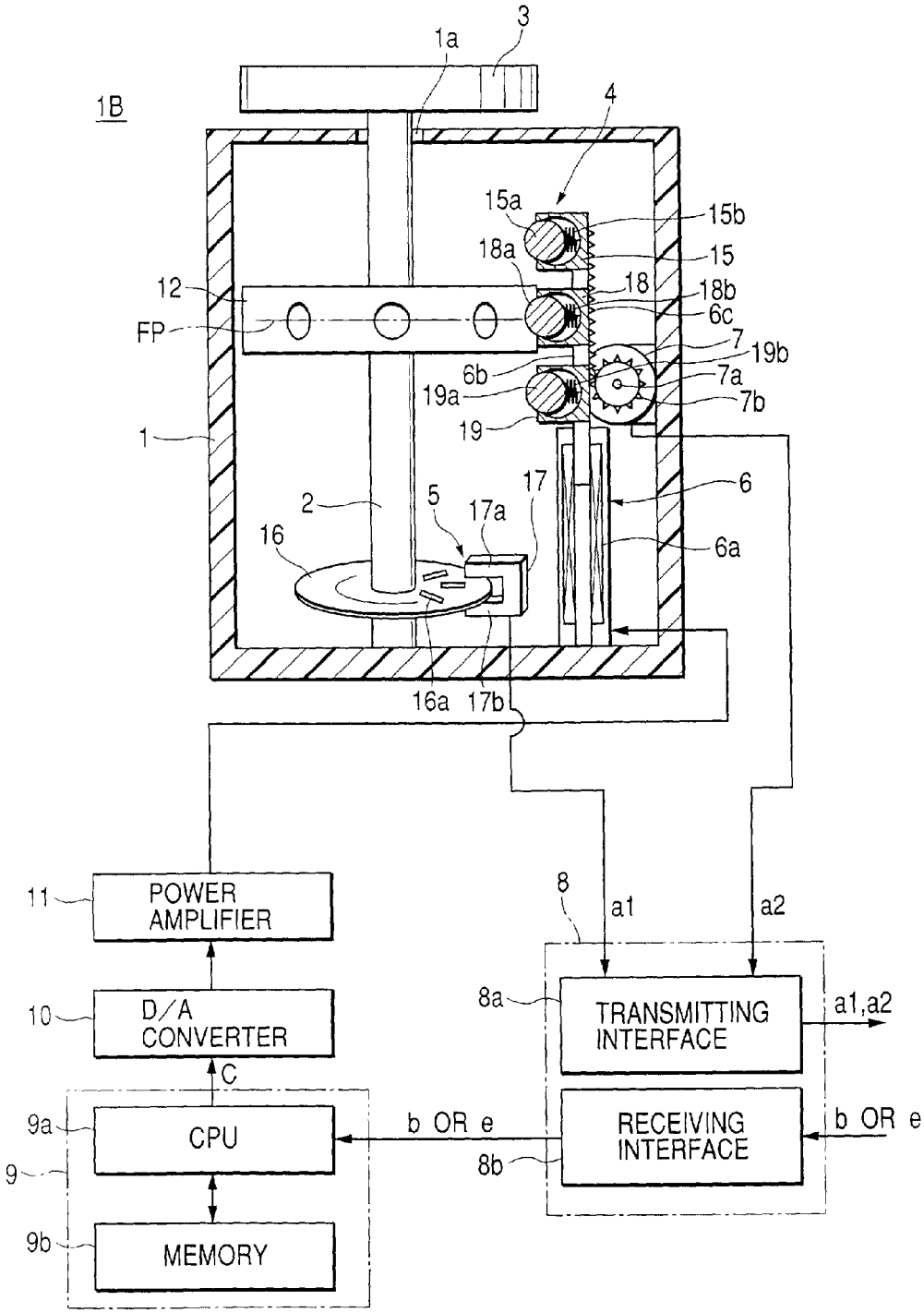
FIG. 2 shows the configuration of a manual input device according to a second embodiment of the invention.

FIG. 2 shows a manual input device 1B according to a second embodiment of the invention. The feeling providing means 4 in this manual input device 1B comprises a single disc 12 fixed to the control shaft 2 and plural ball holders (in FIG. 2, three holders) 15, 18, 19 which work in conjunction with the disc 12 to provide an operation feeling to the knob 3.

The ball holders 15, 18 and 19 are fitted to the drive shaft 6*b* of the actuator 6. The circumferential surface of the disc 12 bears a feeling pattern FP where dents 12*a* with a specific shape and a specific size are evenly spaced with a specific pitch. The ball holders 15, 18, 19 respectively hold balls 15*a*, 18*a*, 19*a* elastically forced to contact the disc 12 selectively, and elastic materials 15*b*, 18*b*, 19*b* which push and hold the balls 15*a*, 18*a*, 19*a* outward to elastically force them to contact the disc 12. The ball holders 15, 18, 19 hold balls 15*a*, 18*a*, 19*a* of different sizes and elastic materials 15*b*, 18*b*, 19*b* with different degrees of elasticity. The other components shown in FIG. 2 are the same as in the manual input device 1A according to the first embodiment, so they are marked with the same reference numerals as in FIG. 1 and their description is omitted here.

In this manual input device 1B, the actuator 6 is driven to move the ball holders 15, 18, 19 in the same direction by the same amount simultaneously to change the ball (15*a*, 18*a* or 19*a* ) to elastically contact the disc 12 and its circumferential surface. After the required ball (15*a*, 18*a* or 19*a* ) is made to contact the circumferential surface of the required disc 12, as the user rotates the knob 3 around the axis of the control shaft 2, the control shaft 2 and disc 12 turn together with the knob 3, the ball (15*a*, 18*a* or 19*a* ), which is held pushed in one direction by the elastic material 15*b*, 18*b* or 19*b*, disengages from a dent 12*a* on the circumferential surface of the disc 12, slides up to the land, then engages with a neighboring dent 12*a*; this cycle is repeated as the knob 3 is turned. As the manipulation force changes, a clicking sensation is thus given to the knob 3. As mentioned above, the ball holders 15, 18, 19 hold balls 15*a*, 18*a*, 19*a* of different sizes and/or elastic materials 15*b*, 18*b*, 19*b* with different degrees of elasticity, so by changing the ball (15*a*, 18*a* or 19*a* ) to contact the circumferential surface of the disc 12, the clicking sensation provided to the knob 3 can be changed. The way the other components work is the same as in the manual input device 1A according to the first embodiment and its description is omitted here.

Thus, in this manual input device 1B, the feeling providing means 4 comprises a single disc 12 fixed to the control shaft 2 and ball holders 15, 18, 19 which respectively hold the balls 15*a*, 18*a*, 19*a* to selectively contact the circumferential surface of the disc 12 with dents 12*a* on it so that the ball (15*a*, 18*a* or 19*a* ) to contact the disc 12 is selected by means of the actuator 6. This makes it possible to provide different modes of operation feeling to the knob 3; therefore, functional control of an electric apparatus can be done easily and adequately with this manual input device 1B. Also, since there is only one disc 12 fixed to the control shaft 2, the manual input device can be compact, lightweight and less costly.

<Manual Input Device—Embodiment 3>

Figure 3:
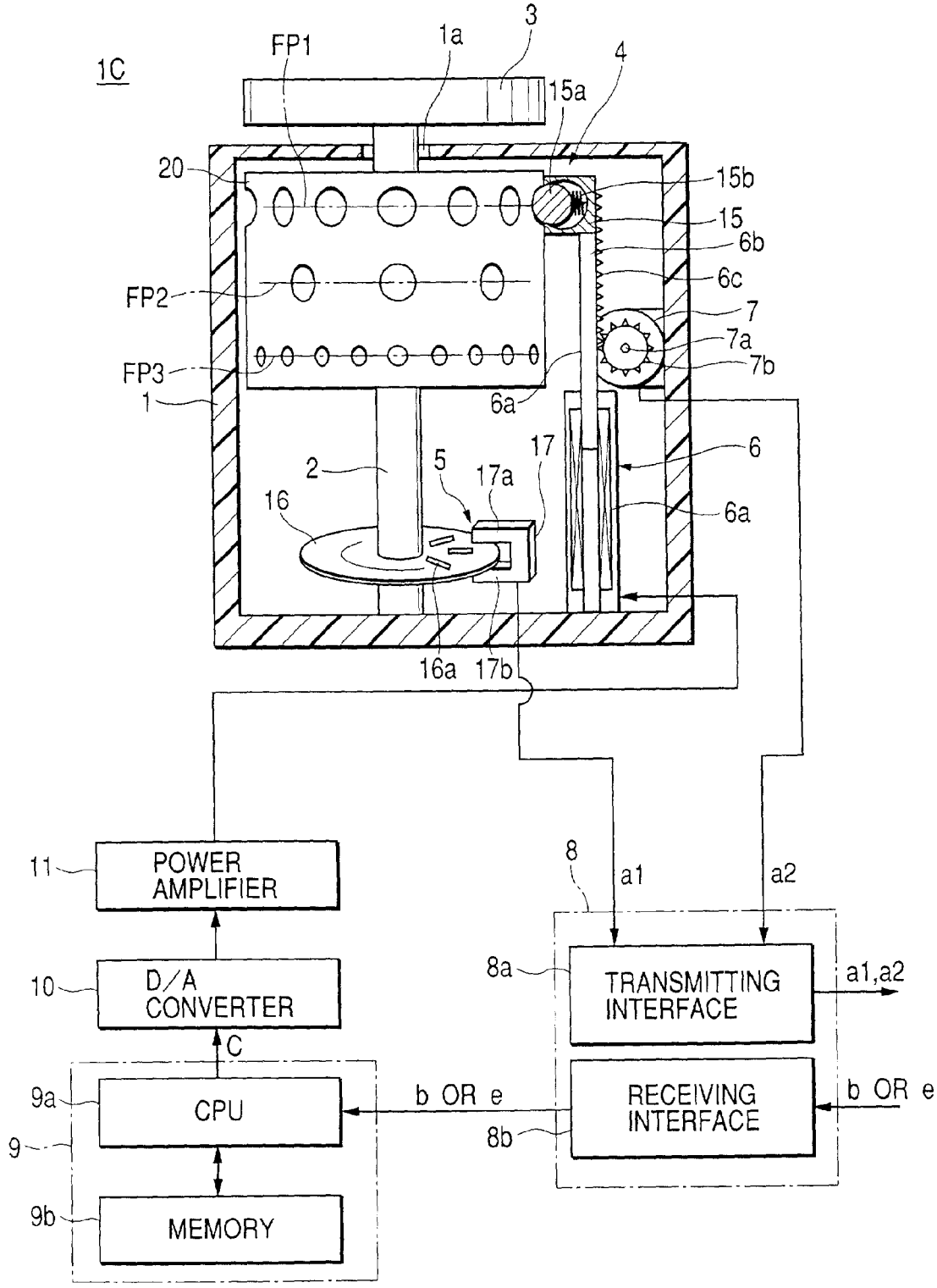
FIG. 3 shows the configuration of a manual input device according to a third embodiment of the invention.

FIG. 3 shows a manual input device 1C according to a third embodiment of the invention. The feeling providing means 4 in this manual input device 1C comprises a single cylinder 20 fixed to the control shaft 2 and a single ball holder 15 which works in conjunction with the cylinder 20 to provide an operation feeling to the knob 3. In the upper area on the outer surface of the cylinder 20 is a first feeling pattern FP1 where dents 12*a* with a large diameter are evenly spaced with a medium pitch; in its center area is a second feeling pattern FP2 where dents 13*a* with a medium diameter are evenly spaced with a large pitch; and in its lower area is a third feeling pattern FP3 where dents 14*a* with a small diameter are evenly spaced with a small pitch. The other components shown in FIG. 3 are the same as in the manual input device 1A according to the first embodiment, so they are marked with the same reference numerals as in FIG. 1 and their description is omitted here. The way the other components work is the same as in the manual input device 1A according to the first embodiment and its description is omitted here.

In this manual input device 1C, the feeling providing means 4 comprises a single cylinder 20 fixed to the control shaft 2 and a single ball holder 15 which works in conjunction with the cylinder 20 to provide an operation feeling to the knob 3, so it brings about the same effects as the manual input devices 1A and 1B according to the first and second embodiments but uses a smaller number of components, leading to cost reduction.

<Manual Input Device—Embodiment 4>

Figure 4:
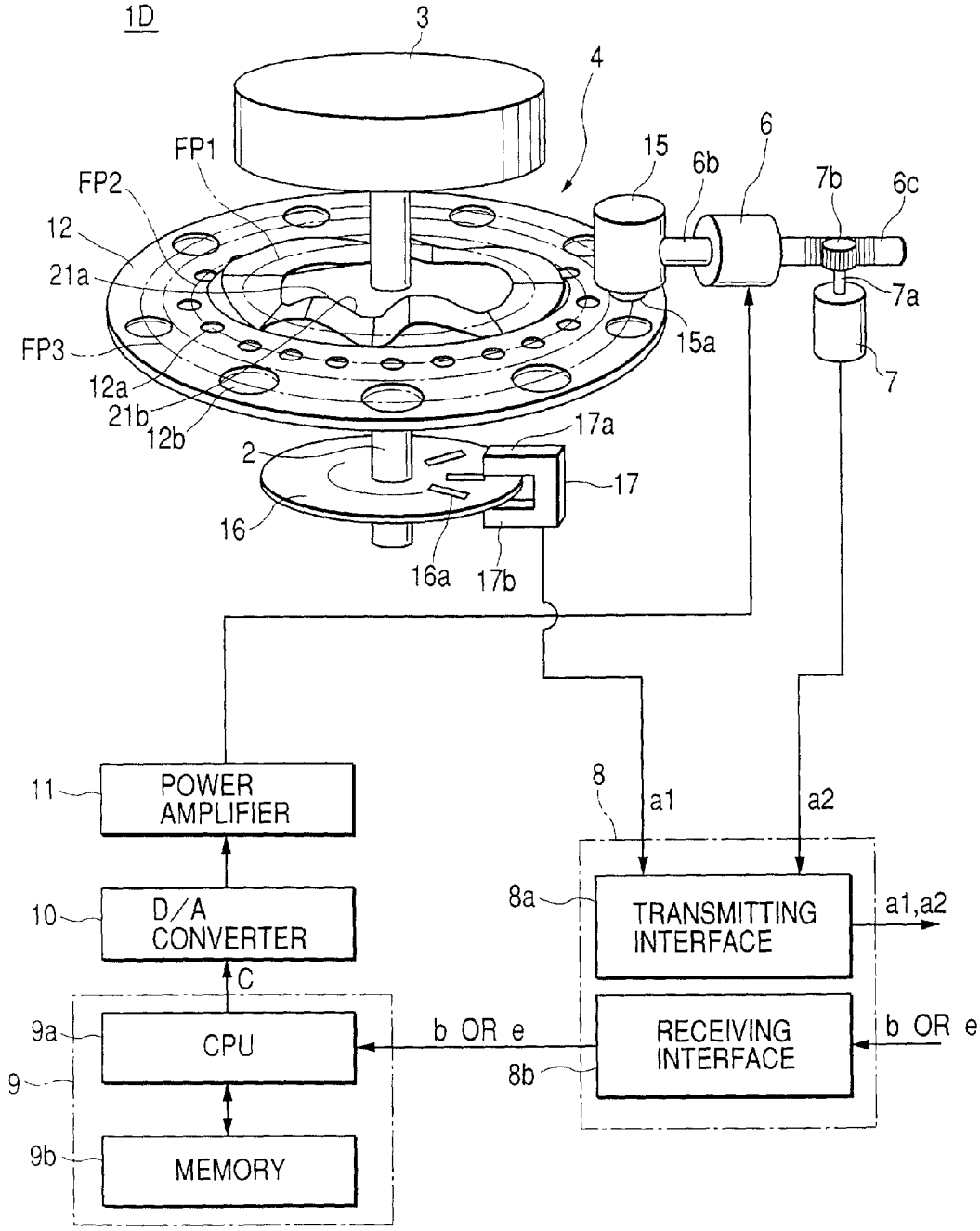
FIG. 4 shows the configuration of a manual input device according to a fourth embodiment of the invention.

FIG. 4 shows a manual input device 1D according to a fourth embodiment of the invention. The feeling providing means 4 in this manual input device 1D comprises a single disc 12 fixed to the control shaft 2 and a ball holder 15 which works in conjunction with the disc 12 to provide an operation feeling to the knob 3, wherein there are plural (in FIG. 4, three) feeling patterns (rows) FP1 to FP3 concentrically formed on the surface of the disc 12 and the ball holder 15 is moved in the radial direction of the disc 12 by the actuator 6.

As shown in FIG. 4, the surface of the disc 12 bears three concentric patterns, a first, a second, and a third feeling pattern FP1, FP2, FP3, where FP1 is a wave pattern with alternate tops 21*a* and bottoms 21*b*, FP2 has small-diameter dents 12*a* spaced with a small pitch and FP3 has large-diameter dents 12*b* spaced with a large pitch. The actuator 6 is equipped with a linear motor such as a voice coil motor and a ball holder 15 is fitted to the tip of the drive shaft 6*b* stretching in the radial direction of the disc 12. The actuator 6 modifies the amount of protrusion of the drive shaft 6*b* and selects one of the feeling patterns FP1 to FP3 to contact the ball 15*a* elastically. When the ball 15*a* is in contact with the first feeling pattern FP1, a feeling of continuous vertical motion can be given to the knob 3; when the ball 15*a* is in contact with the second feeling pattern FP2, a feeling of intermittent motion with a small tactile sensation can be given to the knob 3; and when the ball 15*a* is in contact with the third feeling pattern FP3, a feeling of intermittent motion with a large tactile sensation can be given to the knob 3. The other components shown in FIG. 4 are the same as in the manual input device 1A according to the first embodiment, so they are marked with the same reference numerals as in FIG. 1 and their description is omitted here. The way the other components work is the same as in the manual input device 1A according to the first embodiment except the moving direction of the ball holder 15 and its description is omitted here.

In this manual input device 1D, the feeling providing means 4 comprises a single disc 12 fixed to the control shaft 2 and a ball holder 15 which works in conjunction with the disc 12 to provide an operation feeling to the knob 3, so it brings about the same effects as the manual input devices 1A and 1B according to the first and second embodiments but uses a smaller number of components, leading to cost reduction. In addition, since the ball holder 15 is moved in the radial direction of the disc 12, a thinner model of manual input device can be realized.

<Manual input device—Embodiment 5>

Figure 5:
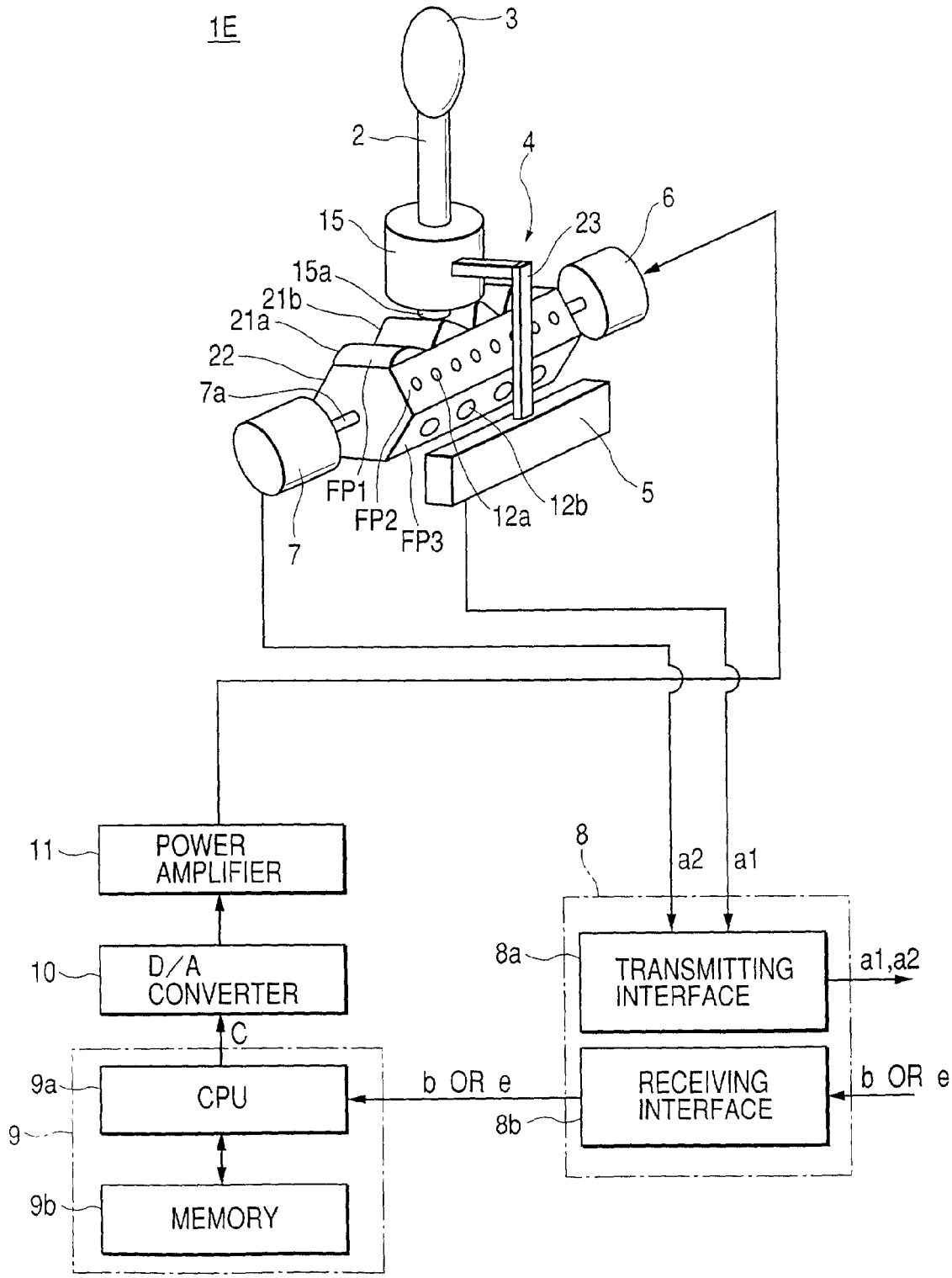
FIG. 5 shows the configuration of a manual input device according to a fifth embodiment of the invention.

FIG. 5 shows a manual input device 1E according to a fifth embodiment of the invention. This manual input device 1E is of the slider type; it uses feeling providing means 4 which comprises a rotary polyhedron 22 which is rotatably supported by a housing 1 (not shown, see FIG. 1) and a single ball holder 15 which is fixed to the control shaft 2 and works in conjunction with the rotary polyhedron 22 to provide an operation feeling to the knob 3, wherein an actuator 6 reciprocally rotates the rotary polyhedron 22 around its axis to change the operation feeling given to the knob 3.

The rotary polyhedron 22's sectional profile which is perpendicular to its axis is hexagonal and a feeling pattern is formed on each of the six faces which are parallel to the axis (FIG. 5 shows only three patterns FP1 to FP3). The first feeling pattern FP1 is a wave pattern with alternate tops 21*a* and bottoms 21*b*, the second feeling pattern FP2 has small-diameter dents 12*a* spaced with a small pitch and the third feeling pattern FP3 has large-diameter dents 12*b* spaced with a large pitch. The actuator 6 uses a rotating motor which reciprocally rotates the rotary polyhedron 22 around its axis. First detecting means 5 is a sliding type variable resistor which outputs a positional signal according to the amount and direction of movement of the control shaft 2 and knob 3, where a slider (not shown) is connected with it through the ball holder 15 and a coupling 23. Second detecting means 7 uses a rotary position sensor such as a rotary encoder or rotary variable resistor whose drive shaft 7*a* is directly connected with the polyhedron 22 so as to detect the rotational position of the rotary polyhedron 22, namely the feeling pattern (FP1, FP2 or FP3) which is in contact with the ball 15*a*.

In this manual input device 1E, the actuator 6 is rotated to switch one feeling pattern (FP1, FP2 or FP3) to contact the ball 15*a* to another. After the ball 15*a* is made to contact the required feeling pattern (FP1, FP2 or FP3), as the knob 3 is linearly moved along the axis of the rotary polyhedron 22, the control shaft 2 and the ball holder 15 move in the same direction by the same amount as the knob 3 and thus the operation feeling matched to the form and/or arrangement of the feeling pattern (FP1, FP2 or FP3) in contact with the ball 15*a* is given to the knob 3. When the ball 15*a* is in contact with the first feeling pattern FP1, a feeling of continuous vertical motion with a strong impact can be given to the knob 3; when the ball 15*a* is in contact with the second feeling pattern FP2, a feeling of intermittent motion with a small tactile sensation can be given to the knob 3; and when the ball 15*a* is in contact with the third feeling pattern FP3, a feeling of intermittent motion with a large tactile sensation can be given to the knob 3. The rotational position of the rotary polyhedron 22 is detected by the second detecting means 7. As the knob 3 is manipulated, the slider (not shown) provided in the first detecting means 5 moves through the control shaft 2, ball holder 15 and coupling 23 in the same direction by the same amount as the knob 3, so the first detecting means can detect the amount and direction of manipulation of the knob 3.

Thus, in this manual input device 1E, the feeling providing means 4 comprises a rotary polyhedron 22 and a single ball holder 15 which is fixed to the linearly movable control shaft 2 and works in conjunction with the rotary polyhedron 22 to provide an operation feeling to the knob 3 and the actuator 6 reciprocally rotates the rotary polyhedron 22 around its axis to change the operation feeling given to the knob 3 so that different modes of operation feeling can be given to the knob of this slider type manual input device and functional control of an electric apparatus with this manual input device can be done easily and adequately.

<Manual Input Device—Embodiment 6>

Figure 6:
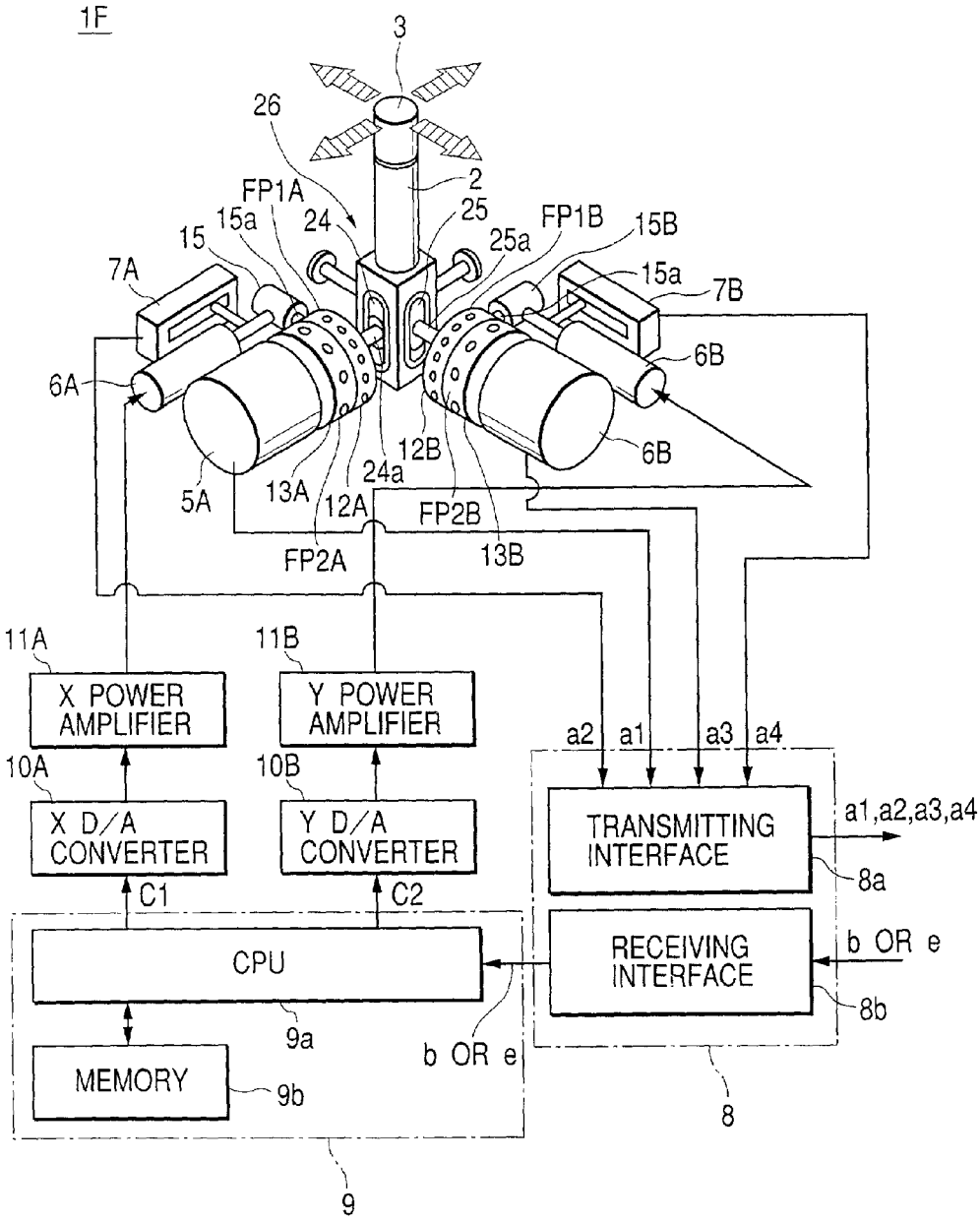
FIG. 6 shows the configuration of a manual input device according to a sixth embodiment of the invention.

FIG. 6 shows a manual input device 1F according to a sixth embodiment of the invention. This manual input device 1F is two-dimensionally manipulated. It comprises: a housing (not shown); a control shaft 2 which is laterally movably supported by the housing; and a knob 3 which is fixed to one end of the control shaft 2; a converter 26 for converting the lateral movement of the control shaft 2 into rotation of an X rotor 24 and a Y rotor 25 which are perpendicular to each other; plural discs (in FIG. 6, two discs) 12A and 13A fixed to the center shaft 24*a* of the X rotor 24, and X first detecting means 5A; feeling patterns FP1A and FP2A formed on the circumferential surfaces of the discs 12A and 13A; a ball holder 15A holding a ball 15*a* to elastically contact the circumferential surfaces of the discs 12A and 13A; an X actuator 6A for driving the ball holder 15A to select the disc 12A or 13A to contact the ball 15*a*; X second detecting means 7A for detecting the amount and direction of drive of the X actuator 6A; plural discs (in FIG. 6, two discs) 12B and 13B fixed to the center shaft 25*a* of the Y rotor 25 and Y first detecting means 5A; feeling patterns FP1B and FP2B formed on the circumferential surface of the discs 12B and 13B; a ball holder 15B holding a ball 15*a* to elastically contact the circumferential surfaces of the discs 12B and 13B; a Y actuator 6B for driving the ball holder 15B to select the disc 12B or 13B to contact the ball 15*a*; Y second detecting means 7B for detecting the amount and direction of drive of the Y actuator 6B; an input/output section 8 which exchanges signals with an external device (not shown); a controller 9 which generates and outputs a control signal c1 for the X actuator 6A and a control signal c2 for the Y actuator 6B based on an external signal b from external detecting means connected with the external device (not shown), or control information e generated based at least on the external signal b; an X D/A converter 10 and a Y D/A converter 10B for converting the control signals c1 and c2 from the controller 9 into analog signals; and an X power amplifier 11A and a Y power amplifier 11B for amplifying the analog signals as a result of conversion of the control signals c1 and c2 by the D/A converters 10A and 10B to obtain the power to drive the actuators 6A and 6B.

The X first detecting means 5A, X second detecting means 7A, Y first detecting means 5B and Y second detecting means 7B may use rotary encoders, potentiometers or the like. The X actuator 6A and Y actuator 6B may use solenoids, linear motors or the like. The input/output section 8, controller 9 and control signals c1 and c2 as commands from the controller 9 are the same as in the manual input device 1A according to the first embodiment, so they are marked in FIG. 6 with the same reference numerals as in FIG. 1 and their description is omitted here.

In this manual input device 1F, as the control shaft 2 is laterally moved, the amount and direction of the lateral movement are converted into a rotational amount and direction of the X rotor 24 and Y rotor 25 which are perpendicular to each other. At the same moment, the discs 12A and 13B rotate along with the X rotor 24 and the discs 12B and 13B rotate along with the Y rotor 25 so that an operation feeling corresponding to feeling pattern FP1A, FP2A, FP1B or FP2B is provided to the knob 3. The operation feeling given to the knob 3 can be changed by driving the X actuator 6A and/or Y actuator 6B to change the feeling pattern (FP1A, FP2A, FP1B or FP2B) to contact the ball 15*a*. The amount and direction of lateral movement of the knob 3 can be calculated from detection signals a1 and a3 coming from the X first detecting means 5A and Y first detecting means 5B. The switching position for the ball holders 15A and 15B can be detected according to detection signals a2 and a4 from the X second detecting means 7A and Y second detecting means 7B.

This manual input device 1F brings about the same effects as the manual input device 1A according to the first embodiment. In addition, since the control shaft 2 is laterally movably supported by the housing, it is possible to apply it to devices whose knob is two dimensionally rotated, such as remote controllers for various electric apparatuses.

<Manual Input Device—Embodiment 7>

Figure 7:
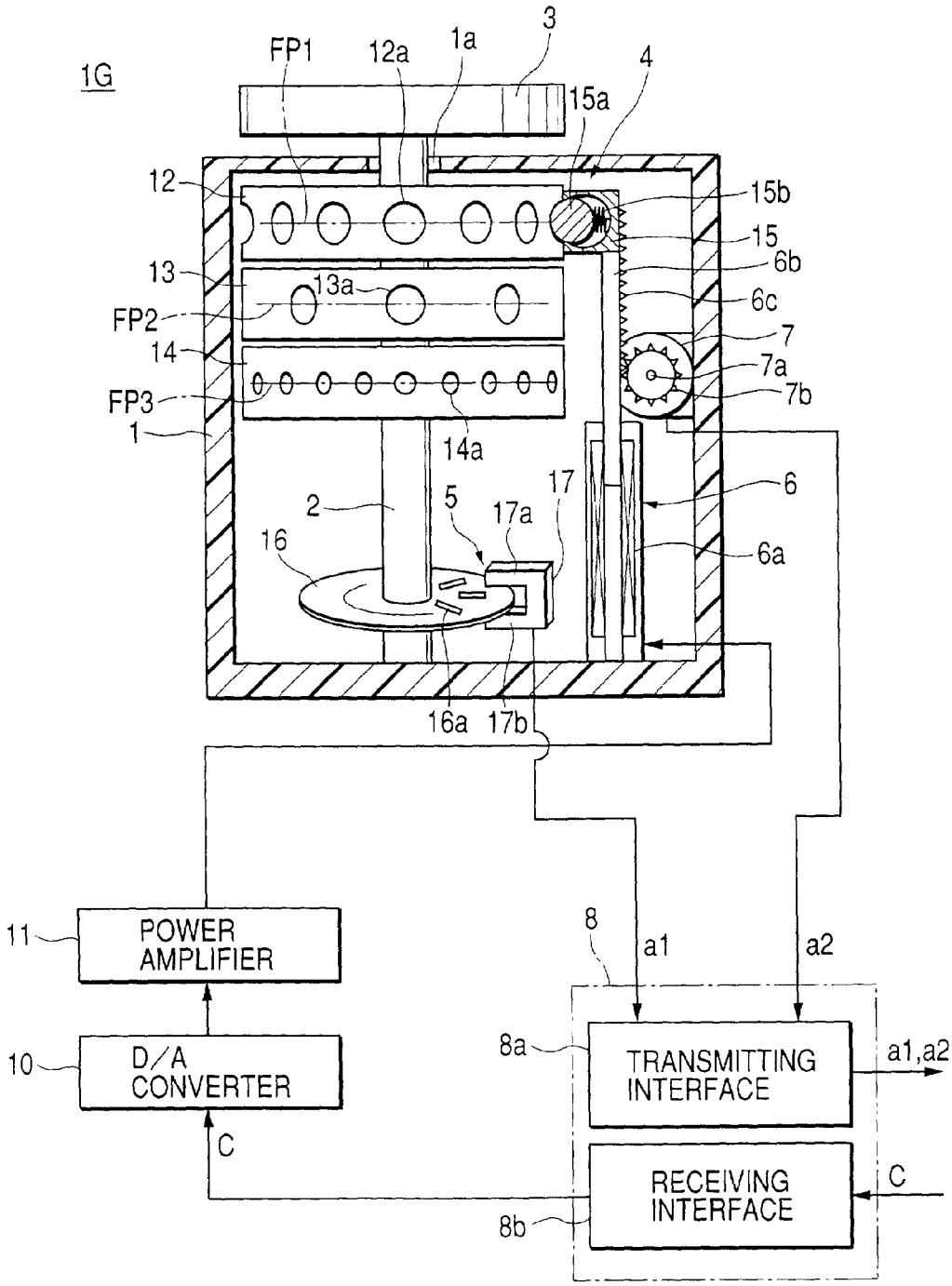
FIG. 7 shows the configuration of a manual input device according to a seventh embodiment of the invention.

FIG. 7 shows a manual input device 1G according to a seventh embodiment of the invention. This manual input device 1G is characterized in that the controller 9 in the manual input device 1A according to the first embodiment as shown in FIG. 1 is omitted. The other components shown in FIG. 7 are the same as in the manual input device 1A according to the first embodiment, so they are marked with the same reference numerals as in FIG. 1 and their description is omitted here. Since the actuator 6 is controlled by control means provided in an external device (not shown), this manual input device 1G brings about the same effects as the manual input device 1A according to the first embodiment. Similarly, it is also possible to omit the controller 9 in the manual input devices 1B (second embodiment) to 1F (sixth embodiment)—in the case of 1F, the X actuator 6A and Y actuator 6B.

<Other Manual Input Device Embodiments>

(1) In the abovementioned embodiments, a control signal c for the actuator 6 is generated based on external signal b or control signal e from the external detecting means connected with the external device; however, the present invention is not limited thereto. It should also be understood that a control signal c for the actuator 6 may be generated based on not only the detection signal a and/or external signal b but also an external signal from another external detection means not connected with the external device, without departing from the spirit and scope of the invention.

(2) In the abovementioned embodiments, the feeling providing means 4 uses a ball 15*a* but it is also possible to use a pin instead of the ball 15*a*. Furthermore, in the case of using plural ball holders 15 as in the manual input device 1B according to the second embodiment, both a ball 15*a* and a pin may be used.

(3) The shape of the knob 3, the positional relation of the control shaft 2 with respect to the housing, the type of detecting means 5 and 7 and the type of actuator 6 are not limited to those illustrated for the above embodiments; modifications and variations may be made as necessary.

<Application Example 1 of Manual Input Device>

Figure 8:
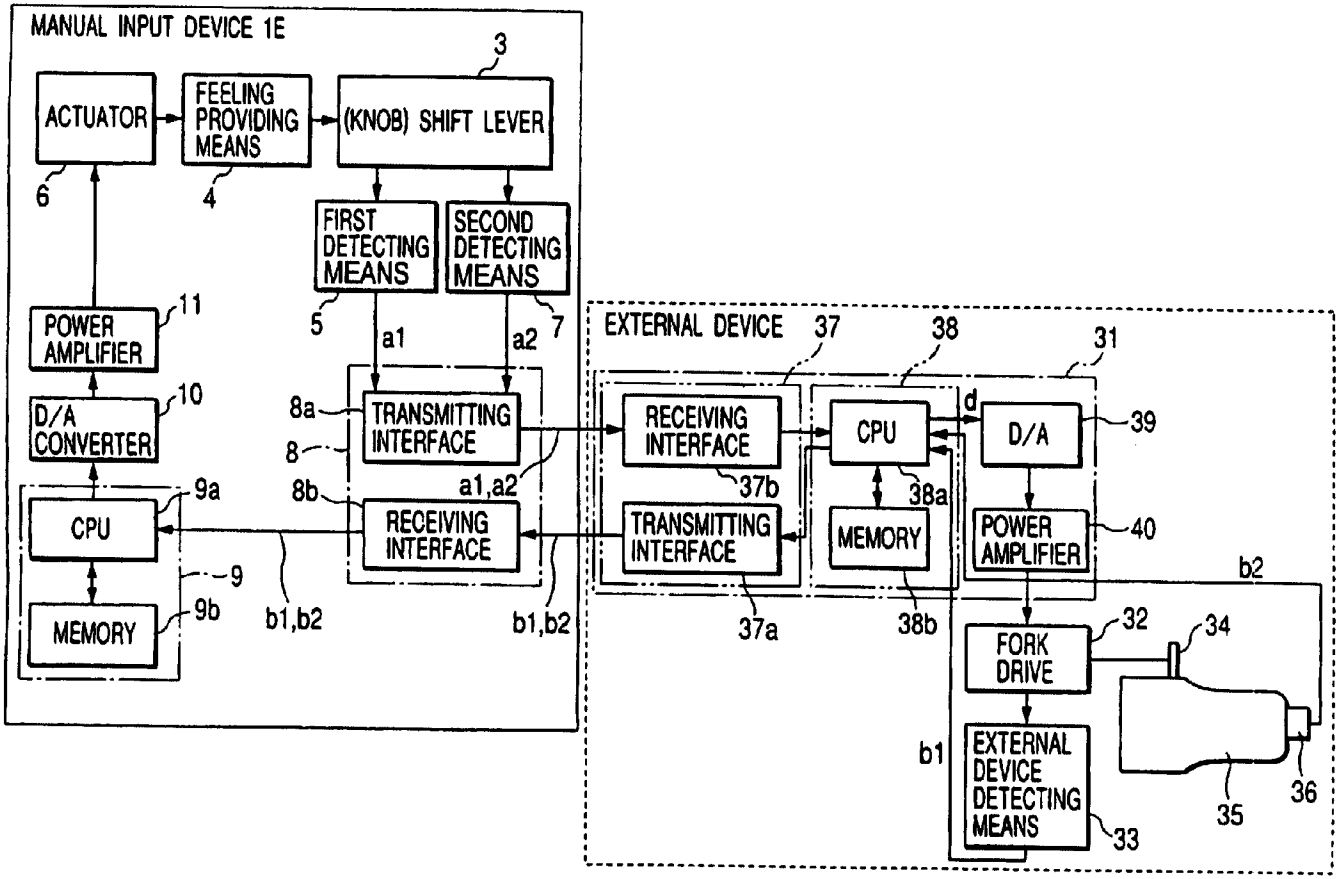
FIG. 8 is a block diagram showing a first application example of a manual input device based on the invention.

Next, a gear shift controller in a car with an automatic transmission to which the sliding type manual input device 1E according to the fifth embodiment is applied will be explained, referring to FIG. 8.

As clearly seen in this figure, this gear shift controller uses the manual input device 1E whose input/output section 8 is connected with an external device consisting of: a transmission controller 31, a fork drive 32 as an actuator such as a solenoid or linear motor to be controlled by the transmission controller 31; external device detecting means 33 for detecting the operating condition of the fork drive 32, such as an encoder or potentiometer; a shift fork 34 to be driven by the fork drive 32; a transmission 35 whose gear engagement is changed by the shift fork 34; and an rpm sensor 36 for detecting the rpm of the output shaft of the transmission 35. In this example, the knob 3 of the manual input device 1E is installed inside a car and used as a shift knob for changing the transmission 35.

The transmission controller 31 is composed of an input/output section 37 which is connected with the input/output section 8 of the manual input device 1E; an external device controller 38 which generates and outputs a drive signal d for the fork drive 32 based on external signal b1 from the external device detecting means 33 and external signal b2 from the rpm sensor 36; a D/A converter 39 which converts the drive signal d from the external device controller 39 into an analog signal; and a power amplifier 40 which amplifies the analog drive signal d from the D/A converter 39 to obtain the power to drive the fork drive 32. If the fork drive 32 uses a stepping motor, the D/A converter 39 can be omitted.

The input/output section 37 includes a receiving interface 37*b* to be connected with the transmitting interface 8*a* in the manual input device 1E's input/output section 8, and a transmitting interface 37*a* to be connected with the receiving interface 8*b* in the manual input device 1E'S input/output section 8. The external device controller 38 is composed of a CPU 38*a* and a memory 38*b*, where the memory 38*b* stores data and a program for analyzing the external signals b1 and b2 as well as drive data and a drive program for the fork drive 32. The CPU 38*a* picks up the external signals b1 and b2, analyzes these detection signals a1 and a2 and external signals b1 and b2 according to the data and program stored in the memory 38*b*, and determines the drive signal d to match the external signals b1 and b2 according to the data and program in the memory 38*b*. Also, the CPU 38*a* sends the external signals b1 and b2 to the controller 9 of the manual input device 1E through the transmitting interface 37*a* and receiving interface 8*b*.

The operational sequence of the gear shift controller thus configured will be explained below.

As the knob is manipulated, the amount and direction of the manipulation is detected by the first detecting means 5, which outputs a detection signal a1 depending on the amount and direction of the manipulation of the knob 3. The engagement of the ball 15*a* with a feeling pattern (FP1, FP2 or FP3) is detected by the second detecting means 7, which outputs a detection signal a2 depending on the amount of operation of the actuator 6. The detection signals a1 and a2 are sent through the transmitting interface 8*a* and receiving interface 37*b* to the external device controller 38. The CPU 38*a* in the transmission controller 31 analyzes the detection signals a1 and a2 and external signals b1 and b2, determines drive signal d to match these signals a1, a2, b1 and b2 according to the data and program stored in the memory 38*b*, and outputs it to the D/A converter 39. The D/A converter 39 converts the drive signal d into an analog signal and outputs it to the power amplifier 40. The power amplifier 40 amplifies the analog signal from the D/A converter 39 and applies it to the fork drive 32. This drives the fork 34 to change the gear engagement of the transmission 35 depending on how the knob 3 is manipulated. The external device controller 38 sends external signal b1 from the external device detecting means 33 and external signal b2 from the rpm sensor 36 through the transmitting interface 37*a* and receiving interface 8*b* to the controller 9 of the manual input device 1E. The controller 9 analyzes the received external signals b1 and b2, determines control signal c to match these signals b1 and b2 according to the data and program stored in the memory 9*b*, and outputs it to the D/A converter. The D/A converter 10 converts the control signal c into an analog signal and outputs it to the power amplifier 11. The power amplifier 11 amplifies the analog signal from the D/A converter 10 and applies it to the actuator 6. This rotates the rotary polyhedron 22 to let the ball 15*a* contact the required feeling pattern; therefore, for example, when the ball 15*a* contacts a feeling pattern for providing a small reactive force to the knob 3, a clicking sensation can be given to the knob 3 for the driver to tactilely perceive a gear shift when he/she shifts the knob 3 from position 1 to another position. If the rpm of the output shaft of the transmission 35 is high, when the driver shifts the knob 3, for instance, from the D range to the R range, manipulation of the knob 3 is made impossible by letting the ball 15*a* contact a feeling pattern for providing a strong reactive force to the knob 3, thereby preventing an erroneous manipulation of the knob 3.

This example uses the manual input device 1E which has a controller 9 and is designed to send external signals b1 and b2 to the controller 9, so there is no need to modify the external device controller 38 and it is easy to apply the manual input device to the transmission controller 31 as an external device.

Instead of the manual input device 1E according to the fifth embodiment, the two-dimensional manipulation type manual input device 1F according to the sixth embodiment may be applied to provide a required operation feeling to the shift knob of a car with a manual transmission.

Instead of or in addition to external signal b2 for information on the rpm of the output shaft of the transmission 35 sent from the rpm sensor 36 to the CPU 38*a*, other external signals for information on car speed and engine rpm can be inputted. In this case, such other external signals for information on car speed, engine rpm, etc. may be either connected with the CPU 38*a* of the external device controller 38 or the CPU 9*a* of the manual input device 1E.

<Application Example 2 of Manual Input Device>

Figure 9:
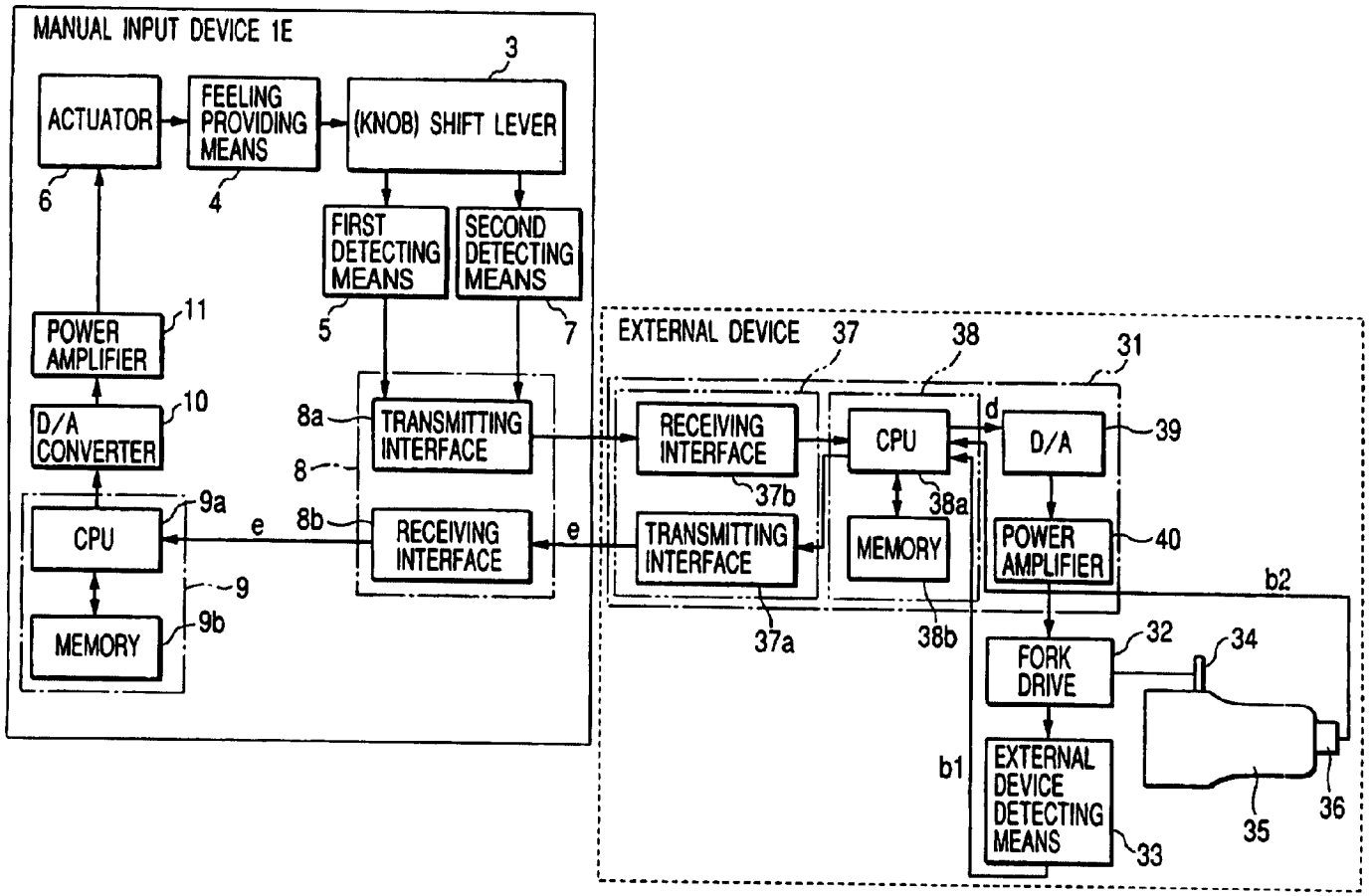
FIG. 9 is a block diagram showing a second application example of a manual input device based on the invention.

Next, a second application example of a manual input device will be explained below referring to FIG. 9. This example also concerns an application of the sliding type manual input device 1E according to the fifth embodiment to the gear shift controller in a car with an automatic transmission. However, it is different from the first example as follows: unlike the first example in which external signals b1 and b2 are sent from the external device controller 38 to the controller 9, control information e is sent to the controller 9 wherein the external device controller 38 converts detection signals a1 and a2 and external signals b1 and b2 or external signals b1 and b2 into control information e whose data structure is simpler.

The memory 38*b* in the external device controller 38 stores a conversion program for converting the detection signals a1 and a2 and external signals b1 and b2 or external signals b1 and b2 picked up by the CPU 38*a* into control information e whose data structure is simpler; the CPU 38*a* starts the conversion program repeatedly to convert the picked-up detection signals a1 and a2 and external signals b1 and b2, or external signals b1 and b2 into control information e and sends it through the transmitting interface 37*a* and receiving interface 8*b* to the controller 9 of the manual input device 1E. For input of other external signals such as those for car speed and engine rpm, these external signals are connected with the CPU 38*a* in the external device controller 38.

The CPU 9*a* of the manual input device 1E analyzes control information e, determines a control signal c to match the control information e according to the data and program in the memory 9*b* and outputs it to the D/A converter 10. The other components and the way they work are the same as in the first example, so they are marked in FIG. 9 with the same reference numerals as in FIG. 8 and their description is omitted here.

In this example, the CPU 38*a* in the external device controller 38 generates control information e whose data structure is simpler than that of detection signals a1 and a2 and external signals b1 and b2 and the controller 9 in the manual input device 1E analyzes this control information e, which reduces the workload on the controller 9 and thereby increases the speed of controlling the actuator 6.

<Application Example 3 of Manual Input Device>

Figure 10:
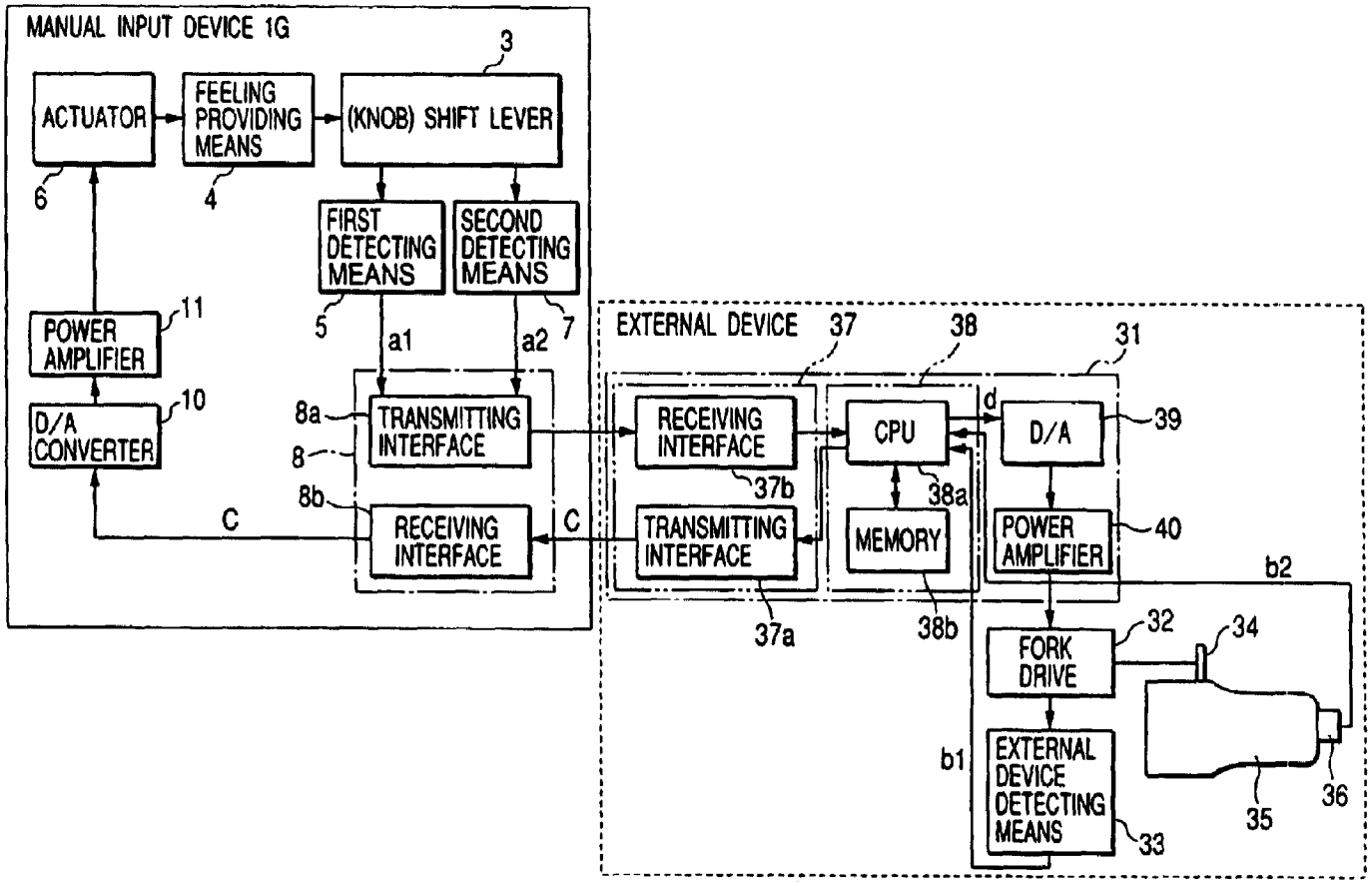
FIG. 10 is a block diagram showing a third application example of a manual input device based on the invention.

Next, a third application example of a manual input device will be explained referring to FIG. 10. This example concerns an application of the manual input device 1G according to the seventh embodiment to the gear shift controller in a car with an automatic transmission. It is characterized in that control signal c for the actuator 6 is sent from the external device controller 38 to the manual input device 1G.

The memory 38*b* in the external device controller 38 stores data and a program for analyzing detection signals a1 and a2 and external signals b1 and b2 picked up by the CPU 38*a* and drive data and a drive program for the actuator 6; the CPU 38*a* starts the drive program repeatedly to generate control signal c for the actuator 6 to match the picked-up detection signals a1 and a2 and external signals b1 and b2, or external signals b1 and b2 and sends it to the D/A converter 10. The other components and the way they work are the same as in the first example, so they are marked in FIG. 10 with the same reference numerals as in FIG. 9 and their description is omitted here.

In this example, the CPU 38*a* in the external device controller 38 controls the actuator 6 in the manual input device 1G so the control section in the manual input device 1G can be omitted, leading to a compact, less costly manual input device.

Other external signals such as those for car speed and engine rpm are connected with the CPU 38*a* in the external device controller 38.

<Application Example 4 of Manual Input Device>

Figure 11:
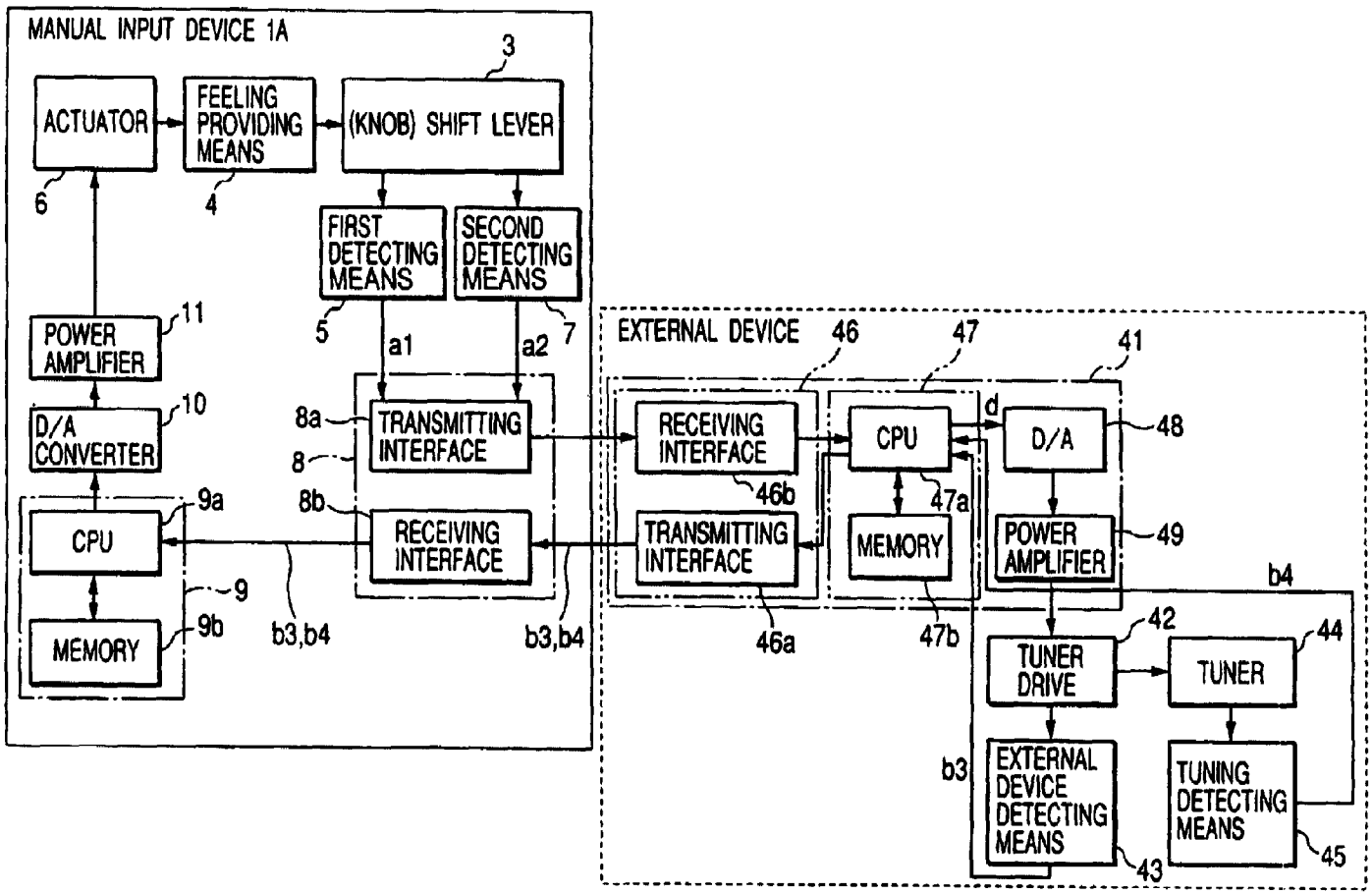
FIG. 11 is a block diagram showing a fourth application example of a manual input device based on the invention.
Figure 12:
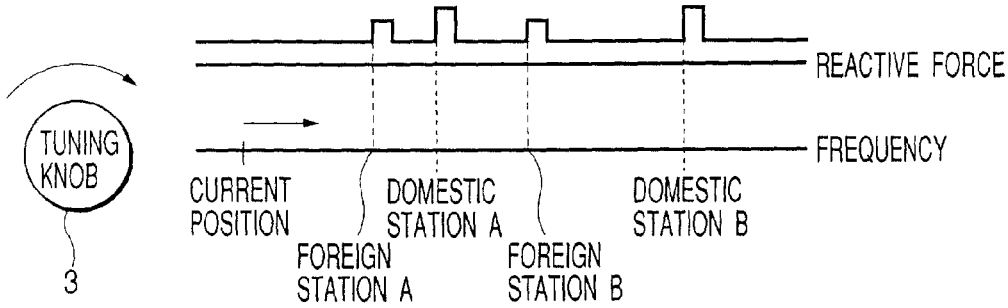
FIG. 12 is a waveform chart concerning an example of operation feeling provided to the knob of the manual input device as the fourth application example.

Next, a radio to which a rotary manual input device 1A according to the first embodiment is applied will be explained, referring to FIGS. 11 and 12.

As clearly understood from these figures, in this radio, the input/output section 8 of the manual input device 1A is connected with an external device consisting of the following: a radio controller 41; a tuner drive 42 which consists of an actuator like a DC motor or stepping motor to be controlled by the controller 41; external detecting means 43 for detecting the operating condition of the tuner drive 42, such as an encoder or potentiometer; a tuner 44 to be driven by the tuner drive 42; and tuning detecting means 45 for detecting the tuner 44's tuning to a radio station. In this example, the knob 3 of the manual input device 1A is installed inside a car and used as a tuner control knob for controlling the tuner 44.

The radio controller 41 is composed of an input/output section 46 which is connected with the input/output section 8 of the manual input device 1A; an external device controller 47 which generates and outputs drive signal d for the tuner drive 42 based on detection signals a1 and a2 from the detecting means 5, external signal b3 from the external device detecting means 43 and external signal b4 from the tuning detecting means 45; a D/A converter 48 which converts the drive signal d from the external device controller 47 into an analog signal; and a power amplifier 49 which amplifies the analog drive signal d from the D/A converter 48 to obtain the power to drive the tuner drive 42. If the tuner drive 42 uses a stepping motor, the D/A converter 49 can be omitted.

The input/output section 46 includes a receiving interface 46*b* to be connected with the transmitting interface 8*a* in the manual input device 1A's input/output section 8, and a transmitting interface 46*a* to be connected with the receiving interface 8*b* in the manual input device 1A's input/output section 8. The external device controller 47 is composed of a CPU 47*a* and a memory 47*b*, where the memory 47*b* stores a program and data for analyzing the detection signals a1 and a2 and the external signals b3 and b4 as well as a drive program and data for the tuner drive 42. The CPU 47*a* picks up the detection signals a1 and a2 and the external signals b3 and b4, analyzes the detection signals a1 and a2 and the external signals b3 and b4 according to the data and program stored in the memory 47*b*, and determines drive signal d to match the detection signals a1 and a2 and the external signals b3 and b4 according to the data and program in the memory 47*b*. Also, the CPU 47*a* sends the external signals b3 and b4 to the controller 9 of the manual input device 1A through the transmitting interface 46*a* and receiving interface 8*b*.

The operational sequence of the radio controller thus configured will be explained below.

As the knob 3 is manipulated, the amount and direction of the manipulation is detected by the first detecting means 5, which outputs detection signal a1 depending on the amount and direction of the manipulation of the knob 3. The engagement of the ball 15*a* with a feeling pattern (FP1, FP2 or FP3) is detected by the second detecting means 7, which outputs detection signal a2 depending on the amount of operation of the actuator 6. The detection signals a1 and a2 are sent through the transmitting interface 8*a* and receiving interface 46*b* to the external device controller 47. The CPU 47*a* in the radio controller 41 analyzes the detection signals a1 and a2 and external signals b3 and b4, determines drive signal d to match these signals a1, a2, b3 and b4 according to the data and program stored in the memory 47*b*, and outputs it to the D/A converter 48. The D/A converter 48 converts the drive signal d into an analog signal and outputs it to the power amplifier 49. The power amplifier 49 amplifies the analog signal from the D/A converter 48 and applies it to the tuner drive 42. This drives the tuner 44 to select a desired radio station. The external device controller 47 sends external signal b3 from the external device detecting means 43 and external signal b4 from the tuning detecting means 45 through the transmitting interface 46*a* and receiving interface 8*b* to the controller 9 of the manual input device 1A. The controller 9 analyzes the received external signals b3 and b4, determines control signal c to match these signals b3 and b4 according to the data and program stored in the memory 9*b*, and outputs it to the D/A converter 10. The D/A converter 10 converts the control signal c into an analog signal and outputs it to the power amplifier 11. The power amplifier 11 amplifies the analog signal from the D/A converter 10 and applies it to the actuator 6. This moves the ball holder 15 to let the ball 15*a* contact a required feeling pattern. Therefore, for example, if the ball 15*a* is made to contact a feeling pattern for providing a relatively strong reactive force to the knob 3 each time the tuner 44 is tuned to a domestic radio station, and the ball holder 15 is driven so as to contact a feeling pattern for providing the ball 15*a* with a relatively small reactive force each time the tuner 44 is tuned to a foreign radio station, tuning to a domestic or foreign radio station can be done accurately. Even if the channel to which the radio has been tuned in with a reactive force is not the desired radio station channel, the knob 3 can be rotated easily by applying a stronger force than the reactive force, and thus the desired station can be selected by this method more quickly than by an auto-scan tuner system in which the tuner stops station by station. In short, this radio controller allows the tuner 34 to tune to a desired station easily and quickly.

The above explanation assumes use of the manual input device 1A according to the first embodiment; however, it should be understood that use of any of the manual input devices 1B to 1D (second to fourth embodiments) brings about the same effects as mentioned above.

<Car-mounted Apparatus Controller Embodiment>

Figure 13:
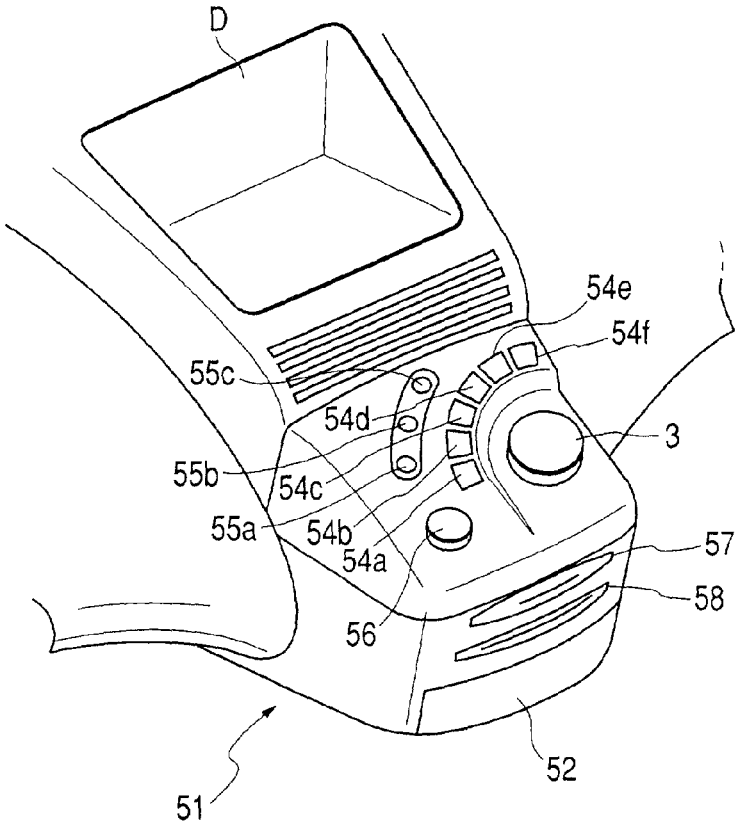
FIG. 13 is a perspective view showing the main part of a car-mounted apparatus controller according to an embodiment which is installed on the dashboard.
Figure 14:
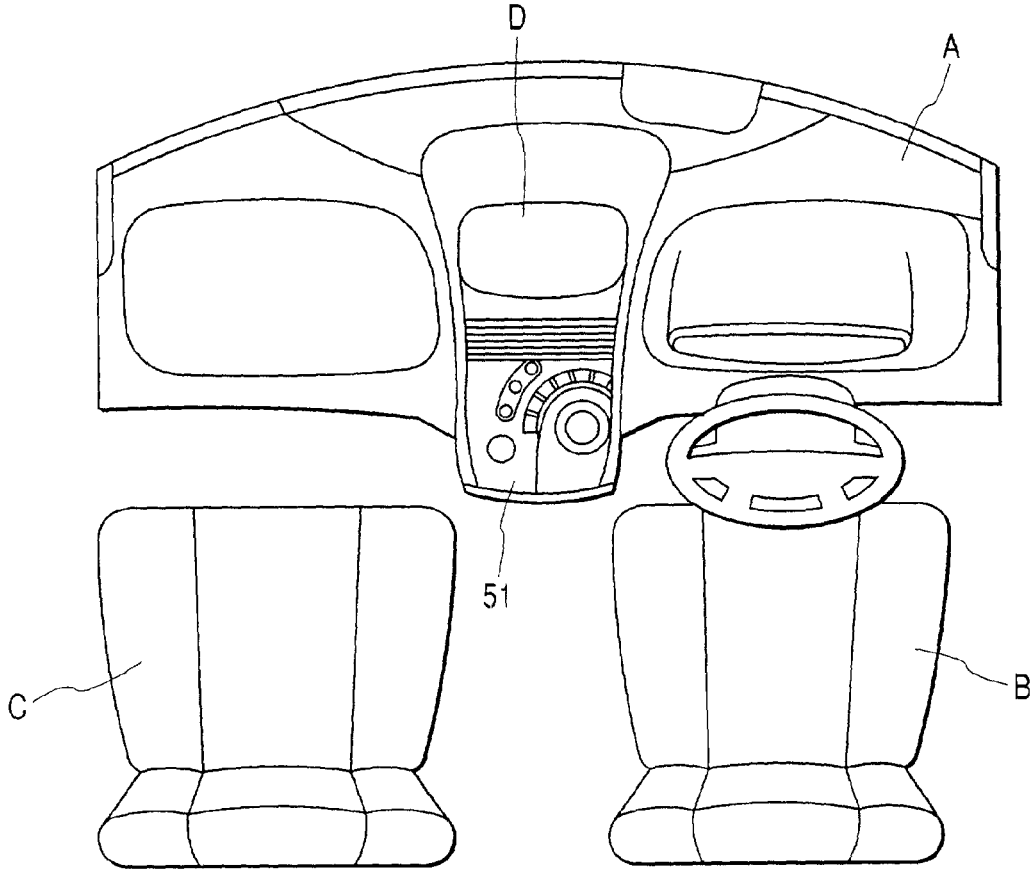
FIG. 14 is a top view partially showing the inside of a car in which a car-mounted apparatus controller according to the embodiment is installed.
Figure 15:
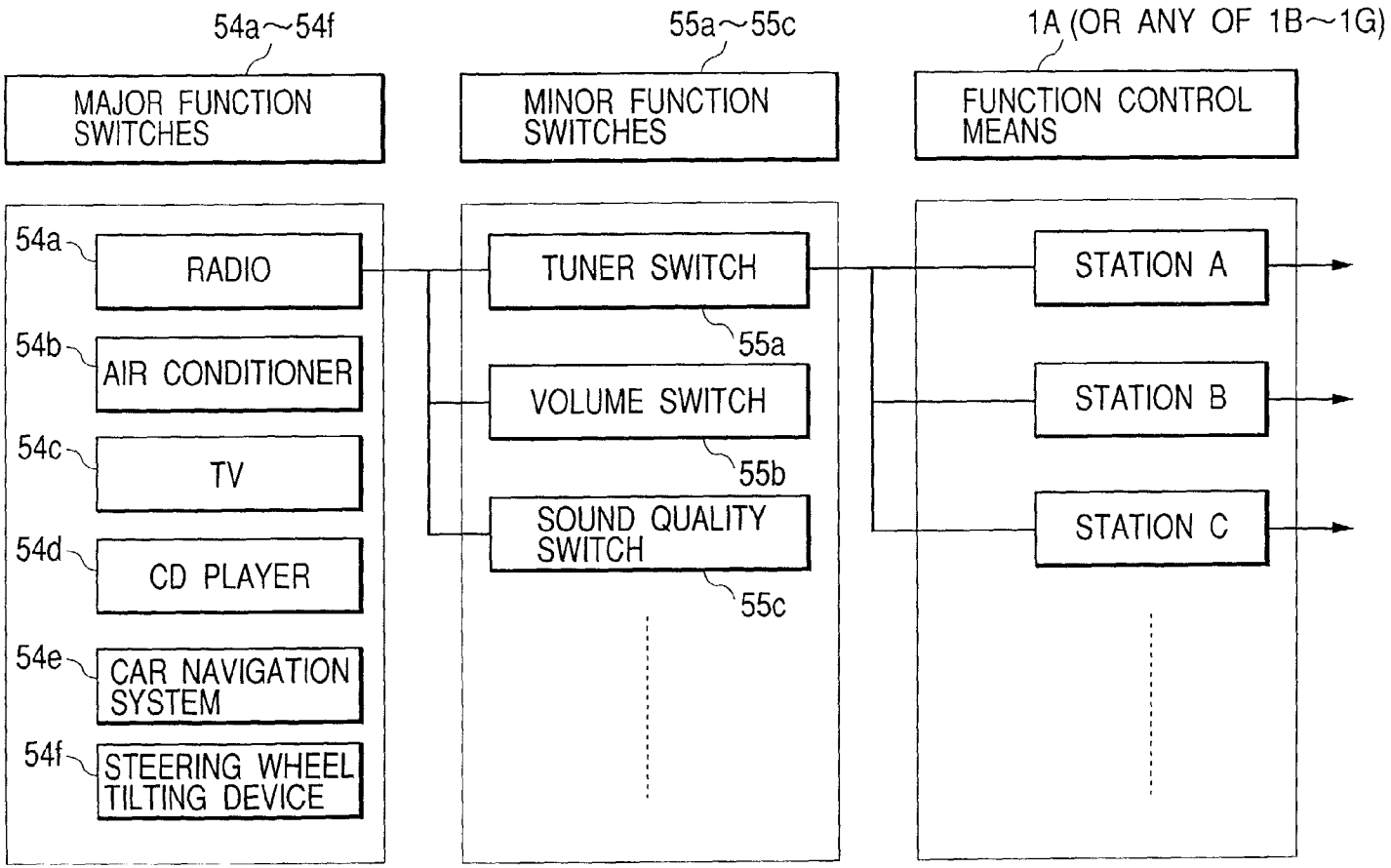
FIG. 15 is a functional block diagram for a carmounted apparatus controller according to the embodiment.

Next, a car-mounted apparatus controller according to an embodiment of the present invention will be described, referring to FIGS. 13 to 15. FIG. 13 is a perspective view showing the main part of a car-mounted apparatus controller according to the embodiment which is installed on the dashboard; FIG. 14 is a top view partially showing the inside of a car in which a carmounted apparatus controller according to the embodiment is installed; and FIG. 15 is a functional block diagram for a car-mounted apparatus controller according to the embodiment.

As shown in FIG. 13, the car-mounted apparatus controller 51 according to this embodiment uses a housing 52 in the form of a rectangular enclosure of a desired size which houses one of the manual input devices 1A to 1G according to the first to seventh embodiments with the device's knob 3 located on the top of the housing. On the top surface of the housing 52 are six pushbutton switches 54*a*, 54*b*, 54*c*, 54*d*, 54*e* and 54*f*, which are arranged along an arc with the position of the knob 3 as its center, three pushbutton switches, 55*a*, 55*b* and 55*c*, which are arranged concentrically around the group of the six pushbutton switches, and a volume control knob 56. On the front of the housing 52 are a card slot 57 and a disk slot 58.

This car-mounted apparatus controller is to be located on the dashboard A, between the driver's seat B and the front passenger's seat C, as shown in FIG. 14.

The six pushbutton switches 54*a* to 54*f* arranged along an arc are used to select various car-mounted electric apparatuses to be operated using this carmounted apparatus controller 51, such as a radio, air conditioner, television, CD player, car navigation system, steering wheel tilting device, seat angle adjuster and telephone, and are individually connected with these apparatuses. Which pushbutton switch should be associated with which car-mounted electric apparatus can be freely determined. In this car-mounted apparatus controller 51, as shown in FIG. 15, the pushbutton switches 54*a*, 54*b*, 54*c*, 54*d*, 54*e* and 54*f* are respectively connected with the radio, air conditioner, television, CD player, car navigation system and steering wheel tilting device. By pushing in the knob of any desired pushbutton switch, the user can select the car-mounted electric apparatus connected with that pushbutton switch.

The three pushbutton switches 55*a* to 55*c* located around the above six pushbutton switches are used to select a function of a car-mounted electric apparatus selected by one of the pushbutton switches 54*a* to 54*f*. For example, if the radio is selected by the pushbutton switch 54*a*, the three pushbutton switches 55*a* to 55*c* serve as a tuner (station selection) switch, a volume switch, and a sound quality switch, respectively, as shown in FIG. 15. The functions selectable by the pushbutton switches 55*a* to 55*c* vary depending on the type of electric apparatus selected by each of the pushbutton switches 54*a* to 54*f*. The manual input device 1A (or any of 1B to 1G) housed in the housing 52 is used as means to control the function selected by the pushbutton switch 55*a*, 55*b* or 55*c*; for instance, if the tuner function is selected by the pushbutton switch 55*a*, tuning of the radio can be done using the knob 3. The tuning sequence and force feedback control of the knob 3 in tuning are the same as previously described under the heading <Application example 4 of manual input device> and thus their description is omitted here.

Figure 16:
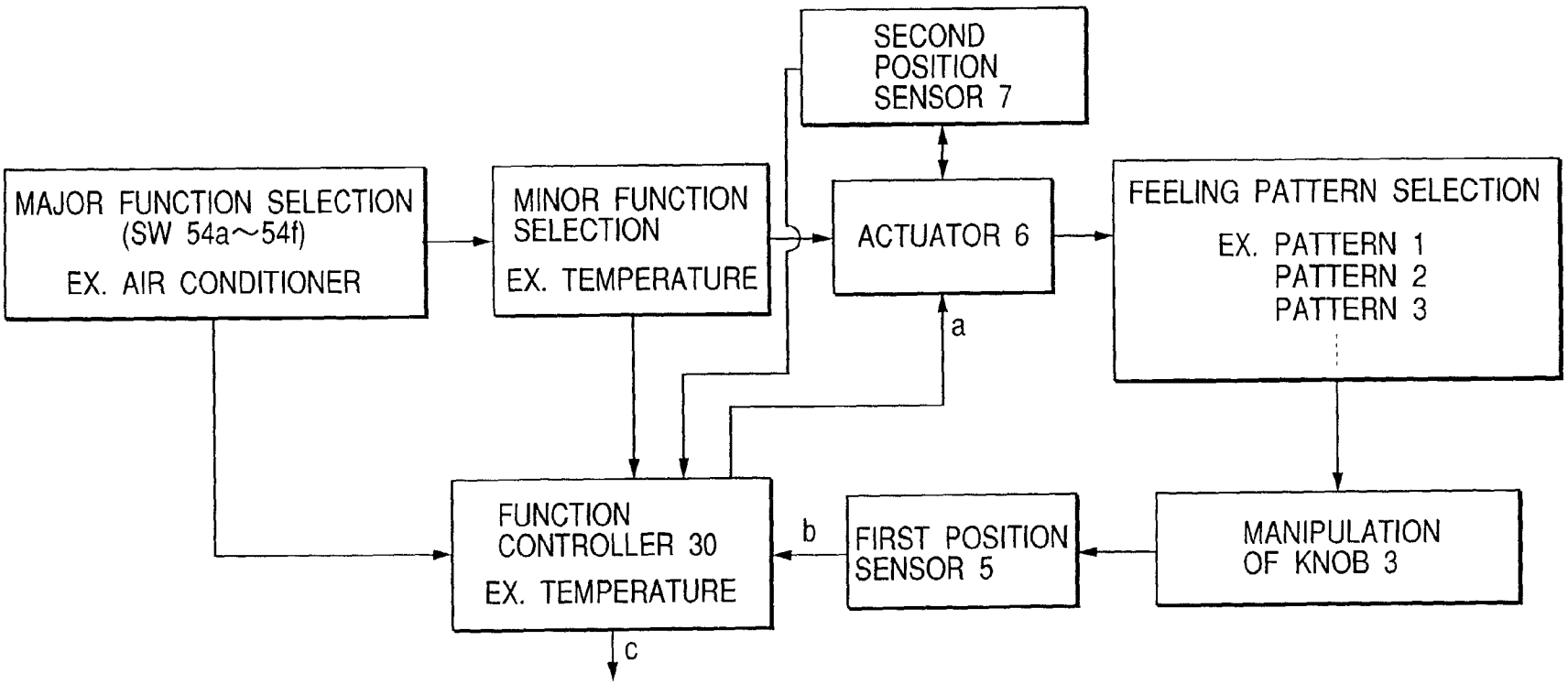
FIG. 16 is an operational block diagram for a car-mounted apparatus controller according to the embodiment.
Figure 17A:
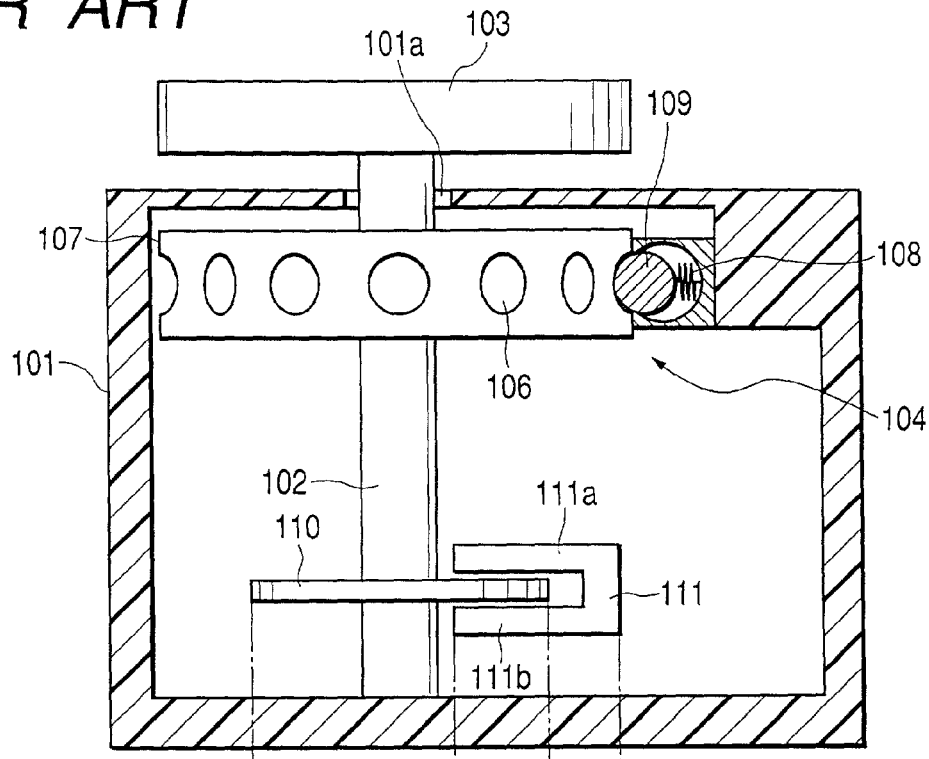
FIG. 17A PRIOR ART
FIGS. 17A and 17B show the configuration of a conventional manual input device.
Figure 17B:
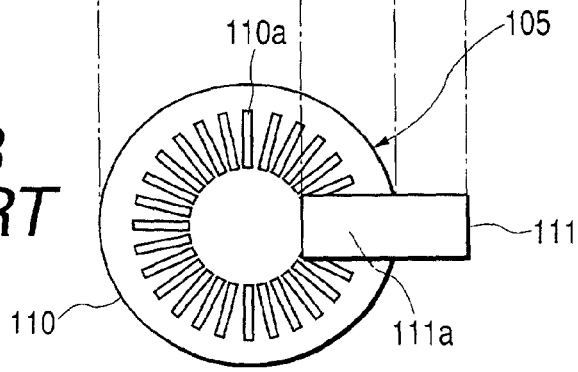
FIG. 17B PRIOR ART

Next, the operational sequence of this car-mounted apparatus controller will be explained, referring to FIG. 16. FIG. 16 is an operational block diagram for a car-mounted apparatus controller according to this embodiment.

After a car-mounted electric apparatus is selected by one of the pushbutton switches 54*a* to 54*f*, one of the pushbutton switches 55*a* to 55*c* is used to select a function of the selected apparatus; then a function controller 30 outputs a control signal a to an actuator 6 depending on the selected electric apparatus and its selected function and the current position of the actuator 6 detected by a second position sensor 7, which drives the actuator 6 to decide the feeling pattern FP1, FP2 or FP3 to be combined with (to contact) the ball 15*a*. As the knob 3 is manipulated in this condition, an operation feeling is provided to the knob 3 depending on the feeling pattern to be combined with the ball 15*a* so that the user can tactilely feel that the function selected by him/her is being controlled with the knob 3. When a different electric apparatus and a different function are selected, the feeling pattern (FP1, FP2 or FP3) to contact the ball 15*a* is different and a different mode of operation feeling is provided to the knob 3. As the knob 3 is manipulated, a signal b which depends on the amount and direction of manipulation of the knob 3 is sent from a first position sensor 5 and the function controller 30 outputs a control signal c according to this signal b and controls the selected function of the selected car-mounted electric apparatus.

As mentioned above, this car-mounted apparatus controller uses a manual input device (any of 1A to 1G) which can provide plural modes of operation feeling to the knob 3 as means for functional control of car-mounted electric apparatuses so that a different operation feeling can be provided to the knob 3 depending on the electric apparatus type and function to be controlled.

Furthermore, since it enables central control of plural car-mounted electric apparatuses, the driver can control various car-mounted electric apparatuses easily, permitting him/her to drive the car with more safety. The operation feeling given to the knob 3 is controlled according to the condition of the electric apparatus to be controlled, so the operability of the knob 3 is improved and electric apparatus functional control with this car-mounted apparatus controller can be done easily and adequately.

Since the manual input device according to the present invention comprises a knob, feeling providing means which have at least two kinds of feeling patterns, and an actuator which activates the feeling providing means and changes the operation feeling given to the knob, the actuator can be driven to activate the feeling providing means so as to change the operation feeling given to the knob as appropriate, so the operability of the manual input device is improved and apparatus functional control with the manual input device is can be done easily and adequately.

Also, since the car-mounted apparatus controller according to the present invention, designed as a manual input device for functional control of an electric apparatus selected by a switch, comprises a knob, feeling providing means which have at least two kinds of feeling patterns, and an actuator which activates the feeling providing means and changes the operation feeling given to the knob, the actuator can be driven to activate the feeling providing means so as to change the operation feeling given to the knob as appropriate, and a different operation feeling can be provided to the knob depending on the car-mounted electric apparatus type and function to be controlled. Therefore, the operability of the car-mounted apparatus controller is improved and electric apparatus functional control with the car-mounted apparatus controller can be done easily and adequately.

What is claimed is:

1. A manual input device comprising:

a knob;

a feeling providing device which has at least two kinds of feeling patterns; and an actuator which positions at least one of a ball or a pin in contact with the feeling providing device, wherein the feeling providing device comprises one of a disc or a cylinder which bears plural feeling patterns (rows) and is fixed to a control shaft to be manipulated by the knob; the at least one of the ball or the pin contacts the one of the disc or the cylinder and changes an operation feeling given to the knob, and wherein the actuator linearly reciprocates the at least one of the ball or the pin in a direction where the plural feeling patterns are arranged.

2. The manual input device according to claim 1, wherein the actuator is controlled according to a control signal generated based on an external signal from an external detector connected at least with the external device.

3. The manual input device according to claim 2, wherein the knob is manipulated by linear movement.

4. The manual input device according to claim 2, wherein the knob is manipulated by rotation.

5. The manual input device according to claim 2, wherein the knob is manipulated by rotation in at least two directions.

6. The manual input device according to claim 2, wherein the feeling providing device comprises one of a disc or a cylinder which bears plural feeling patterns (rows) and is fixed to a control shaft to be manipulated by the knob; and one of a ball or a pin contacts the one of the disc the cylinder, and wherein the actuator linearly reciprocates the one of the ball or the pin in a direction where the plural feeling patterns are arranged.

7. The manual input device according to claim 2, wherein the feeling providing device comprises one of a disc or a cylinder which bears a single feeling pattern (row) and is fixed to a control shaft to be manipulated by the knob; and one of at least two balls or pins contacts the one of the disc or cylinder, and wherein the actuator linearly reciprocates a selected one of the one of the at least two balls or pins in a direction where the selected one of the one of the at least two balls or pins selectively engages with the feeling pattern.

8. The manual input device according to claim 2, wherein the feeling providing device comprises a rotary polyhedron which bears plural feeling patterns (rows) arranged in parallel along an axial direction of an outer surface, and wherein the actuator reciprocally rotates the rotary polyhedron around an axis of the rotary polyhedron, with one end of a control shaft to be manipulated by the knob being in contact with the outer surface of the rotary polyhedron bearing the feeling patterns.

9. The manual input device according to claim 1, having a detector which detects an operating condition of the knob; and an input/output section which exchanges signals with an external device controlled by the knob, wherein both a detection signal at least from the detector and an external signal from an external detector connected with the external device are inputted into the external device to generate a control signal for the actuator to match the detection signal and the external signal, and wherein the actuator is controlled according to the control signal.

10. A manual input device comprising:

a knob;

a feeling providing device which has at least two kinds of feeling patterns; and an actuator which positions at least one of a ball or a pin in contact with the feeling providing device, wherein the actuator positions at least one of multiple balls or pins and the feeling providing device comprises one of a disc or a cylinder which has a single feeling pattern (row) and is fixed to a control shaft to be manipulated by the knob; at least one of the multiple balls or pins contacts the one of the disc or the cylinder, and wherein the actuator linearly reciprocates a selected one of the one of the multiple balls or pins in a direction where the selected one of the one of the multiple balls or pins selectively engages with the feeling pattern.

11. A manual input device comprising:

a knob;

a feeling providing device which has at least two kinds of feeling patterns; and an actuator which positions at least one of a ball or a pin in contact with the feeling providing device, wherein the feeling providing device comprises a rotary polyhedron which bears plural feeling patterns (rows) arranged in parallel along an axial direction of an outer surface, and wherein the actuator reciprocally rotates the rotary polyhedron around an axis of the rotary polyhedron, with one end of a control shaft to be manipulated by the knob being in contact with the outer surface of the rotary polyhedron bearing the feeling patterns.

12. A manual input device comprising:

a knob;

a feeling providing device which has at least two kinds of feeling patterns; and an actuator which positions at least one of a ball or a pin in contact with the feeling providing device;

a control section for the actuator;

a detector which detects an operating condition of the knob; and an input/output section which exchanges signals with an external device controlled by the knob, wherein an external signal from an external detector connected at least with the external device is inputted into the control section through the input/output section to generate a control signal for the actuator to match at least the external signal, and wherein the actuator is controlled according to the control signal.

13. A manual input device comprising:

a knob;

a feeling providing device which has at least two kinds of feeling patterns; and an actuator which positions at least one of a ball or a pin in contact with the feeling providing device;

a control section for the actuator;

a detector which detects an operating condition of the knob; and an input/output section which exchanges signals with an external device controlled by the knob, wherein both a detection signal at least from the detector and an external signal from an external detector connected with the external device are inputted into the external device to generate control information for the actuator to match the detection signal and the external signal, wherein the control information is picked up by the control section through the input/output section to generate a control signal for the actuator to match the control information, and wherein the actuator is controlled according to the control signal.

* * * * *